US011691441B2

(12) United States Patent
Nishi et al.

(10) Patent No.: US 11,691,441 B2
(45) Date of Patent: Jul. 4, 2023

(54) RECORDING APPARATUS

(71) Applicant: SEIKO EPSON CORPORATION, Tokyo (JP)

(72) Inventors: Manato Nishi, Shiojiri (JP); Yuta Watanabe, Matsumoto (JP); Atsuhiko Takeuchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/648,188

(22) Filed: Jan. 18, 2022

(65) Prior Publication Data

US 2022/0227145 A1 Jul. 21, 2022

(30) Foreign Application Priority Data

Jan. 21, 2021 (JP) ..... 2021-008266

(51) Int. Cl.

| | |
|---|---|
| ***B41J 11/00*** | (2006.01) |
| ***B41J 19/14*** | (2006.01) |
| ***B41J 19/00*** | (2006.01) |
| *B41J 2/01* | (2006.01) |
| *B41J 15/04* | (2006.01) |
| *B41J 2/175* | (2006.01) |

(52) U.S. Cl.

CPC ..... *B41J 11/0045* (2013.01); *B41J 19/00* (2013.01); *B41J 19/142* (2013.01); *B41J 2/01* (2013.01); *B41J 2/17553* (2013.01); *B41J 11/005* (2013.01); *B41J 15/04* (2013.01)

(58) Field of Classification Search

CPC ..... B41J 11/0045; B41J 19/00; B41J 19/142; B41J 2/01; B41J 2/17553; B41J 11/005; B41J 15/04

See application file for complete search history.

(56) References Cited

U.S. PATENT DOCUMENTS

| | | | | |
|---|---|---|---|---|
| 5,887,994 A * | 3/1999 | Nomura | B41J 19/00 | 184/100 |
| 6,789,966 B2 * | 9/2004 | Tanaka | B41J 19/00 | 347/198 |
| 2015/0009263 A1 * | 1/2015 | Nakata | B41J 25/3082 | 347/37 |

FOREIGN PATENT DOCUMENTS

| | | |
|---|---|---|
| JP | 2013-166380 A | 8/2013 |
| JP | 2015-013451 A | 1/2015 |
| JP | 2015-124232 A | 7/2015 |

* cited by examiner

*Primary Examiner* — Henok D Legesse
(74) *Attorney, Agent, or Firm* — Workman Nydegger

(57) ABSTRACT

A recording apparatus includes a recording head configured to perform recording on a recording medium being conveyed in a conveyance direction, a carriage in which the recording head is mounted, the carriage being configured to perform scanning in a scanning direction that intersects the conveyance direction, and a guide member including a flat surface configured to guide the carriage in the scanning direction. The carriage includes a sliding part configured to slide in contact with the guide member, an impregnated member impregnated with lubricant on at least one side of the sliding part in the scanning direction, and a pressure member configured to press the impregnated member to the guide member side from a surface on a side opposite to the guide member with respect to the impregnated member.

12 Claims, 11 Drawing Sheets

RECORDING APPARATUS

The present application is based on, and claims priority from JP Application Serial Number 2021-008266, filed Jan. 21, 2021, the disclosure of which is hereby incorporated by reference herein in its entirety.

BACKGROUND

1. Technical Field

The present disclosure relates to a recording apparatus including a carriage in which a recording head that performs recording on a medium such as a sheet is mounted.

2. Related Art

As an example of a recording apparatus, a serial-type recording apparatus including a carriage in which a recording head that performs recording on a recording medium such as a sheet is mounted, and a guide member that supports the carriage such that the carriage is movable in the scanning direction that intersects the conveyance direction of the recording medium is known (for example, JP-A-2015-13451 and JP-A-2016-124232).

For example, JP-A-2015-13451 discloses a recording apparatus with a configuration in which a guide member is a guide rail, and a sliding part of a slide member and a carriage slide on the guide rail to which lubricant is applied. The load of the sliding resistance of the carriage guided by the guide rail to move in the scanning direction is reduced by the lubricant.

In addition, JP-A-2016-124232 discloses a recording apparatus with a configuration in which a guide member is a guide shaft, and a lubricant supply part that supplies lubricant to the guide shaft is provided. The lubricant supply part supplies lubricant by making contact with the outer peripheral surface of the guide shaft. A member such as a felt impregnated with lubricant is used for the lubricant supply part. Note that JP-A-2016-124232 also discloses a configuration in which the guide member is a guide plate, but does not disclose a specific configuration of the lubricant supply part for the guide plate.

However, in the case where the configuration disclosed in JP-A-2016-124232 including a lubricant supply part for supplying lubricant is applied in the configuration disclosed in JP-A-2015-13451, the intensity of the contact of the impregnated member such as a felt that makes up the lubricant supply part with the guide rail may vary depending on the variation of the orientation of the carriage with respect to the guide rail. When the contact intensity varies on the weak side, the impregnated member may be separated from the sliding surface (rail surface) of the guide rail, and the contacting pressure against the sliding surface may be excessively reduced, which may result in stagnation of the supply of the lubricant between the sliding part and the sliding surface. In this case, the carriage movement speed may be varied by a large sliding resistance due to the shortage of the lubricant, and this results in disadvantages such as reduction in the recording accuracy of the recording apparatus, and reduction in the lifetime of the recording apparatus 11 due to the sliding part of the carriage prematurely worn out.

SUMMARY

A recording apparatus that solves the above-described problems includes a recording head configured to perform recording on a recording medium being conveyed in a conveyance direction, a carriage in which the recording head is mounted, the carriage being configured to perform scanning in a scanning direction that intersects the conveyance direction, and a guide member including a flat surface configured to guide the carriage in the scanning direction. The carriage includes a sliding part configured to slide in contact with the guide member, an impregnated member impregnated with lubricant on at least one side of the sliding part in the scanning direction, and a pressure member configured to press the impregnated member to the guide member side from a surface on a side opposite to the guide member with respect to the impregnated member.

DESCRIPTION OF EXEMPLARY EMBODIMENTS

An embodiment of a recording apparatus is described below with reference to the accompanying drawings. Note that the recording apparatus of this embodiment is an ink-jet printer that performs printing (recording) of letters, images and the like on a medium such as a sheet by discharging liquid such as ink to the medium.

The recording apparatus rotatably holds a roll body of a recording medium wound around a core member, and records an image and the like on the recording medium by discharging liquid to the surface of the recording medium pulled out from the roll body.

Configuration of Recording Apparatus

Figure 1:
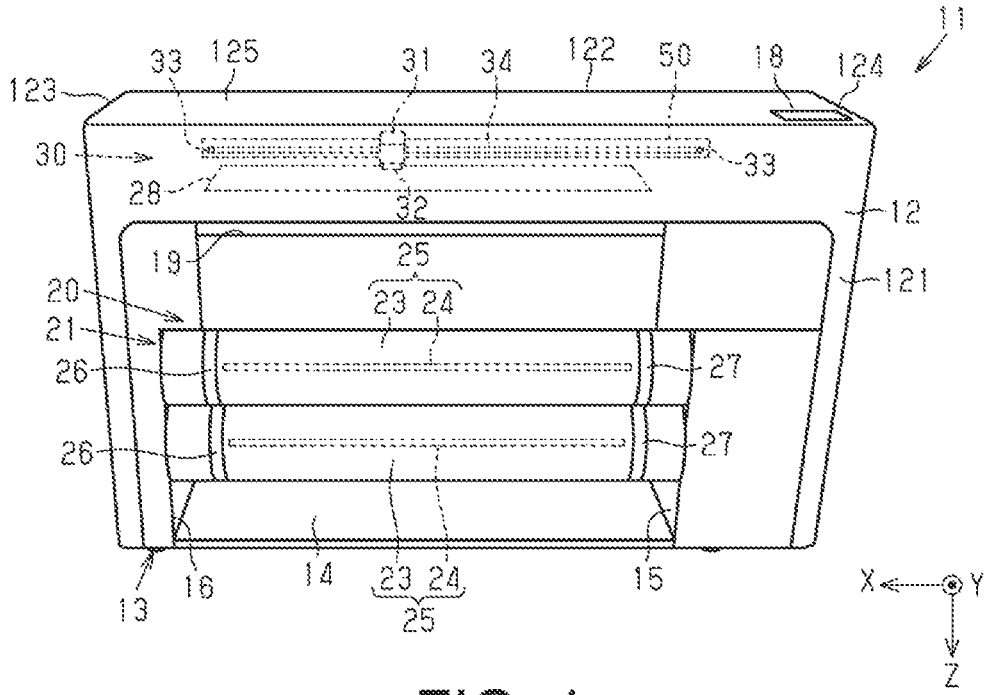
FIG. 1 is a front view illustrating a recording apparatus of an embodiment.

As illustrated in FIG. 1, a recording apparatus 11 includes a housing 12, and a leg part 13 that supports the housing 12.

The housing 12 has a substantially cuboid shape. The housing 12 includes a front wall 121, a rear wall 122, a first side wall 123, a second side wall 124, an upper wall 125 and a base frame 14 supported by the leg part 13.

In the following description, a vertical direction Z is defined based on the assumption that the recording apparatus 11 is placed on a horizontal plane. A direction that is a direction along a plane orthogonal to the vertical direction Z and is the movement direction of a carriage 31 is referred to as a scanning direction X, and a direction that is the direction along a plane orthogonal to the vertical direction Z and intersects the scanning direction X is a conveyance direction Y, because this is the conveyance direction of the medium at the recording position where a recording head 32 mounted to the carriage 31 performs recording on the recording medium. Note that the scanning direction X includes a+X direction, which is the outward direction of one direction of the back-and-forth movement of the carriage 31, and a−X direction, which is the direction opposite to the outward direction. In addition, a conveyance direction D (see FIG. 2) in which the medium is conveyed changes depending on the position on the conveyance path of the recording medium. The conveyance direction Y is equal to the conveyance direction D at the recording position. In addition, in this embodiment, the scanning direction X is referred to also as a width direction X, because this is equal to the width direction, which intersects the conveyance direction of the recording medium. Further, the vertical direction Z includes a lower direction+Z, which is one direction of the vertical direction, and an upward direction−Z, which is the direction opposite to the lower direction+Z. Note that in this embodiment, the scanning direction X, the conveyance direction Y and the vertical direction Z are orthogonal to each other.

As illustrated in FIG. 1, the housing 12 includes a housing part 15 that houses two cylindrical roll bodies 25. The housing part 15 includes an opening 16 at a lower portion in the front wall 121 of the housing 12, and the roll body 25 can be attached and detached from the front surface side through the opening 16.

Conveyance Part

The recording apparatus 11 includes a conveyance part 20 that conveys a recording medium 23 from the roll body 25. The conveyance part 20 includes a feeding part 21 that unwinds and feeds the recording medium 23 from the roll body 25, and a plurality of conveyance roller pairs 22 that conveys the fed recording medium 23 in a sandwiching manner (see FIG. 2). The recording apparatus 11 includes a support base 28 that supports the recording medium 23 being conveyed. The support base 28 extends along a region that faces the recording head 32 when the carriage 31 moves in the scanning direction X. The upward side of the support base 28 is a scanning region where the carriage 31 moves when a recording part 30 performs recording on the recording medium 23 supported by the support base 28. In addition, the region on the support base 28 is a recording region where the recording head 32 performs recording on the recording medium 23.

The support base 28 is a member with a rectangular plate shape that extends in the width direction X in the housing 12. The recording medium 23 unwound and output from the roll body 25 is conveyed in the housing 12 to the support base 28, and then conveyed on the support base 28 toward the conveyance direction Y.

As illustrated in FIG. 1, the recording apparatus 11 can house the two roll bodies 25 aligned in the vertical direction Z in the housing part 15. The roll body 25 is composed of the recording medium 23 as the recording object wound around a core member 24.

End portions of the two roll bodies 25 are held by a first holding part 26 that holds one end of the roll body 25, and a second holding part 27 that holds the other end of the roll body 25. The roll body 25 is configured such that it can be dismounted from the housing 12 through the opening 16 in the state where it is held by the first holding part 26 and the second holding part 27.

The first holding part 26 and the second holding part 27 are mounted such that they are rotatable with respect to the housing 12 around the axis line extending in the width direction X. In this manner, the roll body 25 is held such that it is rotatable with respect to the housing 12.

The roll body 25 is driven into rotation by a driving part not illustrated in the drawing. Through forward rotation driving of a drive motor not illustrated in the drawing, the driving part not illustrated in the drawing rotates the first holding part 26 and the second holding part 27 in the output direction of the recording medium 23 wound around the roll body 25. Note that in an actual recording, the recording medium 23 is output from only one of the two roll bodies 25. When the recording medium 23 of one of the two roll bodies 25 is used up, the recording medium 23 pulled out from the other roll body 25 prepared in advance is set, and thus the printing can be restarted with a short interruption time.

Figure 2:
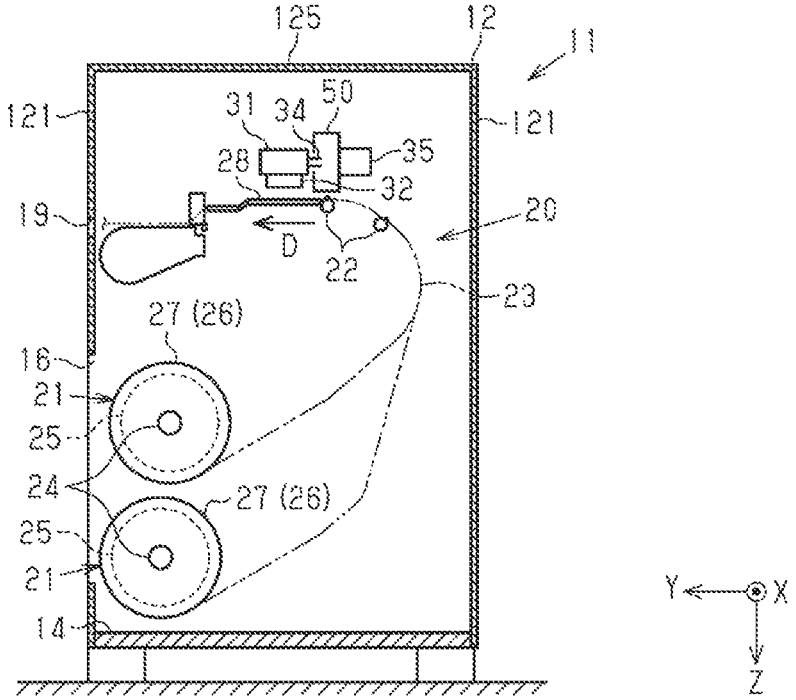
FIG. 2 is a schematic side sectional view illustrating the recording apparatus.

As illustrated in FIG. 2, the recording medium 23 fed from the roll body 25 is sent to the conveyance roller pair 22 along the path indicated by the chain double-dashed line in FIG. 2. Then, the plurality of conveyance roller pairs 22 conveys the recording medium 23 on the path that passes over the support base 28. The recording part 30 performs recording on the recording medium 23 supported by the support base 28, and the recorded recording medium 23 is cut as necessary and then ejected from an ejection port 19. In addition, the recording apparatus 11 includes an operation part 18 in the upper wall 125 of the housing 12. The operation part 18 is operated by the user when providing a request to the recording apparatus 11. The operation part 18 includes at least one of an operation button and a touch-screen display part.

Recording Part

As illustrated in FIG. 1, the recording apparatus 11 includes the recording part 30 at a position on the upper side of the housing part 15 in the housing 12. The recording part 30 includes the recording head 32 that performs recording on the recording medium 23 being conveyed in the conveyance direction Y, the carriage 31 that moves (scans) in the scanning direction X that intersects the conveyance direction Y with the recording head 32 mounted therein, a guide member 50 that guides the carriage 31 such that the carriage 31 is movable along the scanning direction X. The guide member 50 includes a flat surface.

The carriage 31 is guided along the guide member 50. In addition, the carriage 31 is fixed to a part of an endless synchronous belt 34 stretched and extended along the guide member 50. The both end portions of the synchronous belt 34 in the scanning direction X are wound around a pair of pulleys 33. One of the pair of pulleys 33 is a drive pulley coupled with an output shaft of a carriage motor 35 (see FIG. 3), and the other of the pair of pulleys 33 is a driven pulley. When the carriage motor 35 is forward/reverse driven, the carriage 31 moves back and forth in the scanning direction X. When the carriage motor 35 is forward/reverse driven, the carriage 31 moves back and forth in the scanning direction X.

The guide member 50 supports the carriage 31 at a position upward of the support base 28. The guide member 50 is a member extending along the scanning direction X. The guide member 50 supports the carriage 31 such that the carriage 31 is movable along the scanning direction X.

As illustrated in FIG. 1 and FIG. 2, in the carriage 31, the recording head 32 is mounted at a lower portion that can face the support base 28. When the carriage motor 35 is driven, the carriage 31 moves along the guide member 50 and thus moves the recording head 32 back and forth in the scanning direction X. The recording head 32 performs recording by discharging liquid to a recording surface of the recording medium 23, which is a surface parallel to the XY plane, while performing scanning in the width direction X that intersects the conveyance direction Y of the recording medium 23.

The recorded recording medium 23 is guided to the ejection port 19. The portion recorded by the recording medium 23 is cut by a cutting part not illustrated in the drawing. In this case, the cut recording medium 23 is ejected from the ejection port 19.

Next, specific configurations of the recording part 30 and the guide member 50 are described with reference to FIG. 3.

Figure 3:
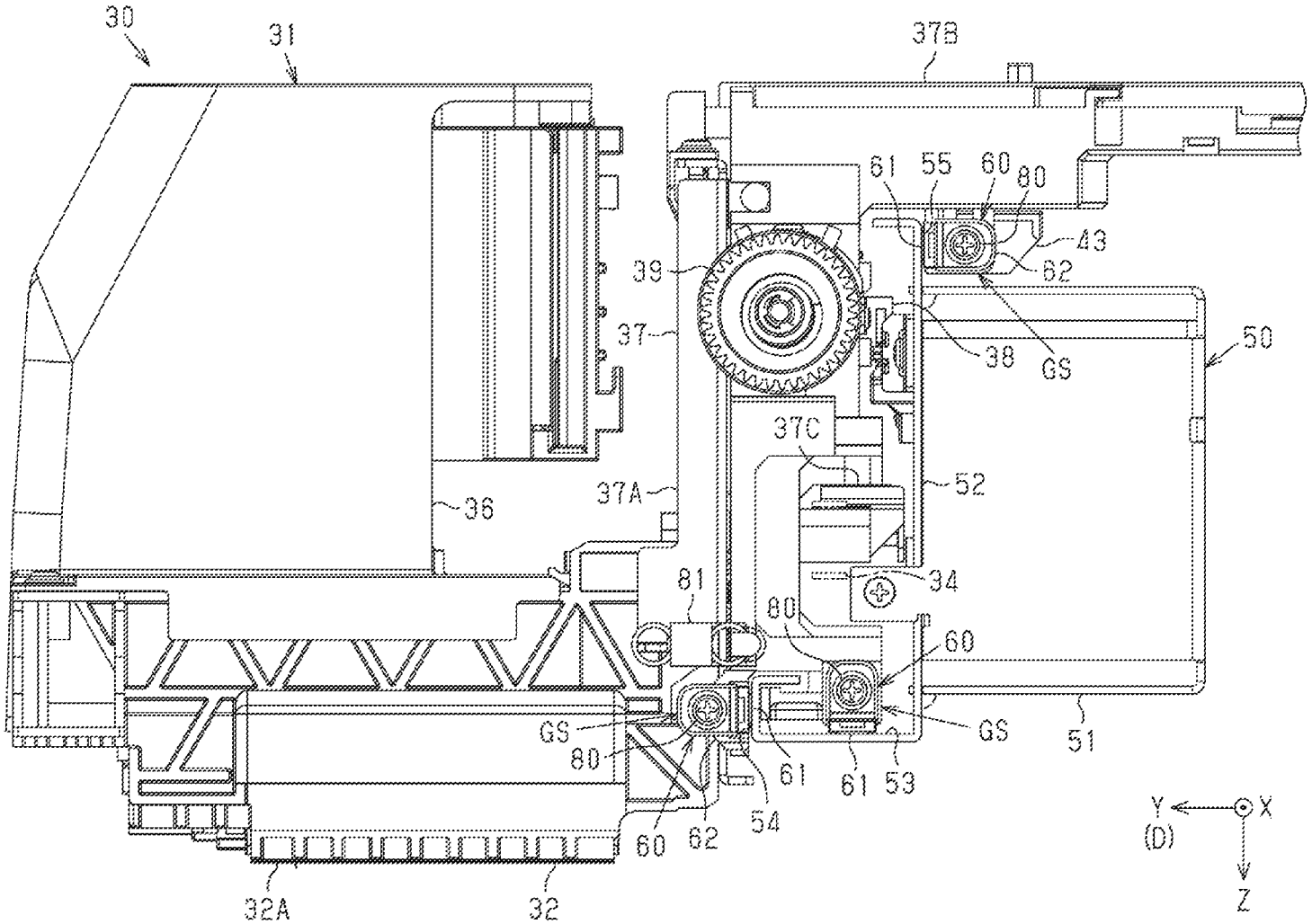
FIG. 3 is a side view illustrating a recording part and a guide member.

As illustrated in FIG. 3, the recording part 30 includes the carriage 31, and the recording head 32 mounted in the carriage 31. The carriage 31 includes a carriage main body 36 that is a portion for supporting the recording head 32, and a carriage supporting part 37 disposed on the rear side of the carriage main body 36 and interposed between the carriage main body 36 and the guide member 50. The carriage supporting part 37 engages, to the guide member 50, the carriage 31 in a movable state in the scanning direction X. The guide member 50 may be composed of a part of a main frame provided in the housing 12, for example. In this case, the guide member 50 includes a frame main body 51 and a rail part 52 that guides the carriage 31. Note that the guide member 50 need not have the configuration that serves also as a main frame, and may be provided across the inside of the housing 12 as a member separated from a main frame.

Configuration of Recording Part

As illustrated in FIG. 3, the recording part 30 includes the carriage 31 supported in such a manner that it can move along the guide member 50 in the scanning direction X, and the recording head 32 mounted in the carriage 31.

The carriage supporting part 37 includes an upright part 37A extending in the vertical direction Z, and a protruding portion 37B protruding rearward (−Y direction) from the upper end portion of the upright part 37A.

The synchronous belt 34 is fixed to the carriage supporting part 37 through a belt fixing part 37C. In addition, a sensor of a linear encoder 38 is fixed to the carriage supporting part 37. Further, a gear 39 is attached to the carriage supporting part 37 of this example. For example, when the carriage 31 moves to a predetermined position on the path in the scanning direction X, the gear 39 is engaged with a drive gear, and the rotational force of the drive gear is input into the carriage 31 through the gear 39. A predetermined driving mechanism of the carriage 31 is driven.

As illustrated in FIG. 3, the carriage 31 includes a sliding part 61 that slides in contact with rail surfaces 53 to 55 as an example of the flat surface of the guide member 50. In this embodiment, the sliding part 61 is provided as a unit as a sliding unit 60. A plurality of the sliding units 60 is detachably mounted to the carriage 31.

The plurality of sliding units 60 includes a first sliding unit 60 that presses the sliding part 61 against the rail surface in the +Z direction, a second sliding unit 60 that presses the sliding part 61 against the rail surface in the −Y direction, and a third sliding unit 60 that presses the sliding part 61 against the rail surface in the +Y direction.

The rail part 52 includes the rail surfaces 53 to 55 composed of flat surfaces serving as sliding surfaces on which the sliding part 61 on the carriage 31 side slides when the carriage 31 moves in the scanning direction X. The rail part 52 of this example includes the rail surface 53 orthogonal to the vertical direction Z, and the rail surfaces 54 and 55 orthogonal to the conveyance direction Y. Specifically, in the example illustrated in FIG. 3, the rail part 52 includes the first rail surface 53 composed of a flat surface that is orthogonal to the vertical direction Z and faces the +Z direction, the second rail surface 54 composed of a flat surface that is orthogonal to the conveyance direction Y and faces the +Y direction, and the third rail surface 55 composed of a flat surface that is orthogonal to the conveyance direction Y and faces the −Y direction.

In the side view illustrated in FIG. 3, when the sliding part 61 strongly pushes the first rail surface 53 in the +Z direction, the carriage 31 acts to turn and displace counterclockwise, and consequently the other sliding part 61 tends to float from the rail surfaces 54 and 55. In addition, when the sliding part 61 strongly pushes the second rail surface 54 in the −Y direction, the carriage 31 acts to turn and displace clockwise, and accordingly the other sliding part 61 tends to float from the rail surfaces 53 and 55. Further, when the sliding part 61 strongly pushes the third rail surface 55 in the +Y direction, the carriage 31 acts to turn and displace clockwise, and consequently the other sliding part 61 tends to hit the rail surface 53 with an excessive strength and to float from the rail surface 54.

The positional variation of the carriage 31 in the conveyance direction Y is suppressed by pressing the sliding part 61 toward the −Y direction against the second rail surface 54 and pressing the sliding part 61 toward the +Y direction against the third rail surface 55. That is, the moving carriage 31 guided by the guide member 50 is positioned in the conveyance direction Y. In addition, the positional variation of the carriage 31 in the vertical direction Z is suppressed by pressing the sliding part 61 toward the vertical direction Z (the +Z direction) against the first rail surface 53.

As illustrated in FIG. 3, the recording head 32 includes a nozzle surface 32A that is parallel to the XY plane composed of the width direction X and the conveyance direction Y. Specifically, the recording head 32 includes the nozzle surface 32A that is parallel to the recording surface of the recording medium 23 conveyed in the conveyance direction Y on the support base 28.

Configuration of Recording Part

Figure 4:
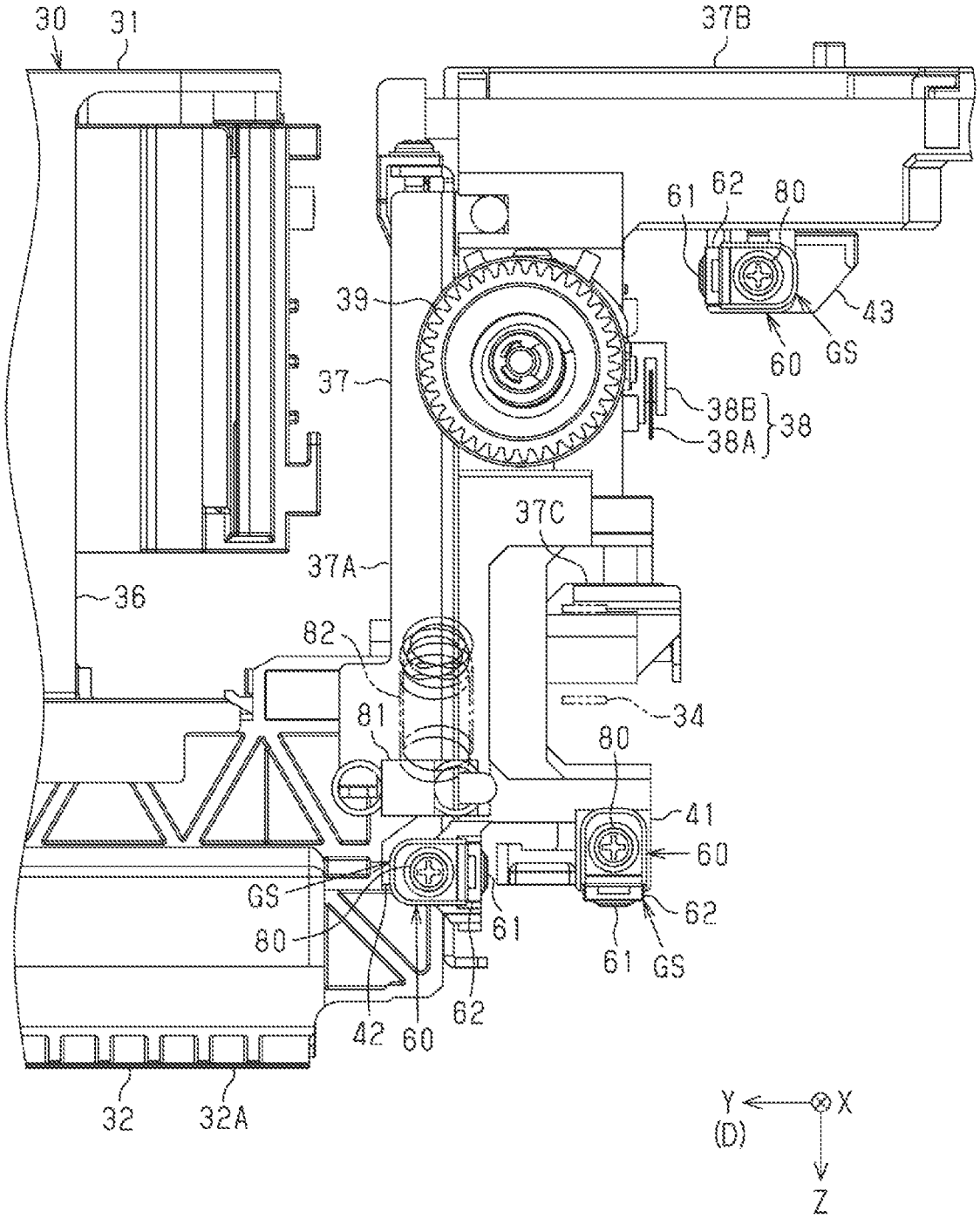
FIG. 4 is a side view illustrating a carriage guide structure.

FIG. 4 illustrates the carriage supporting part 37 in the state where the guide member 50 is dismounted. As illustrated in FIG. 4, the carriage 31 includes a plurality of the sliding parts 61. Specifically, the carriage 31 includes the sliding parts 61 of a plurality of types with different orientations of orientations, including a sliding part 61 that faces the vertical direction Z, a sliding part 61 that faces the −Y direction, and a sliding part 61 that faces the +Y direction. The sliding parts 61 of the plurality of types with different orientations are mounted to the carriage 31 as a part of a sliding mechanism GS. The sliding mechanism GS includes the sliding unit 60 mounted to the carriage 31 in a slidable manner. By mounting the sliding unit 60 to the carriage 31, the sliding part 61 is mounted in a predetermined direction at a predetermined position of the carriage 31.

As illustrated in FIG. 4, the carriage supporting part 37 is provided with mounting parts 41 to 43. When the sliding unit 60 provided with the sliding part 61 is mounted to the mounting parts 41 to 43, each sliding part 61 is mounted in a predetermined direction with respect to the carriage supporting part 37.

The sliding unit 60 includes the sliding part 61 and a slider 62 (casing) that is mounted in the state where the sliding part 61 is exposed. The sliding unit 60 is fit to the mounting parts 41 to 43 in a sliding manner and is thus positioned at a predetermined position. Then the positioned sliding unit 60 is fixed to the mounting parts 41 to 43 with a screw 80, and is thus held at the predetermined position where it is positioned.

The carriage 31 includes a plurality of springs 81 and 82 that biases the plurality of sliding parts 61 with different pressing directions such that the plurality of sliding parts 61 can be pressed against the corresponding rail surfaces 53 to 55. Specifically, in the carriage supporting part 37, the first spring 81 for applying a bias in the conveyance direction Y, and the second spring 82 for applying a bias in an oblique direction having components in both the scanning direction X and the vertical direction Z, are provided in a stretched manner. Note that one or more springs for applying a bias that allows for pressing the sliding part 61 against the corresponding rail surfaces 53 to 55 may be provided for each type of the sliding parts 61 disposed in the same direction.

In addition, as illustrated in FIG. 4, a sensor 38B that optically reads a linear scale 38A making up the linear encoder 38 is attached to a rear part of the carriage supporting part 37. The sensor 38B outputs a detection signal including a number of pulses proportional to the movement length of the carriage 31 in the scanning direction X. In addition, the belt fixing part 37C that fixes the synchronous belt 34 is provided at a rear part of the carriage supporting part 37. When the synchronous belt 34 fixed to the belt fixing part 37C is rotated in forward and reverse directions by the forward/reverse drive of the carriage motor 35, the carriage 31 can move back and forth in the scanning direction X.

Figure 5:
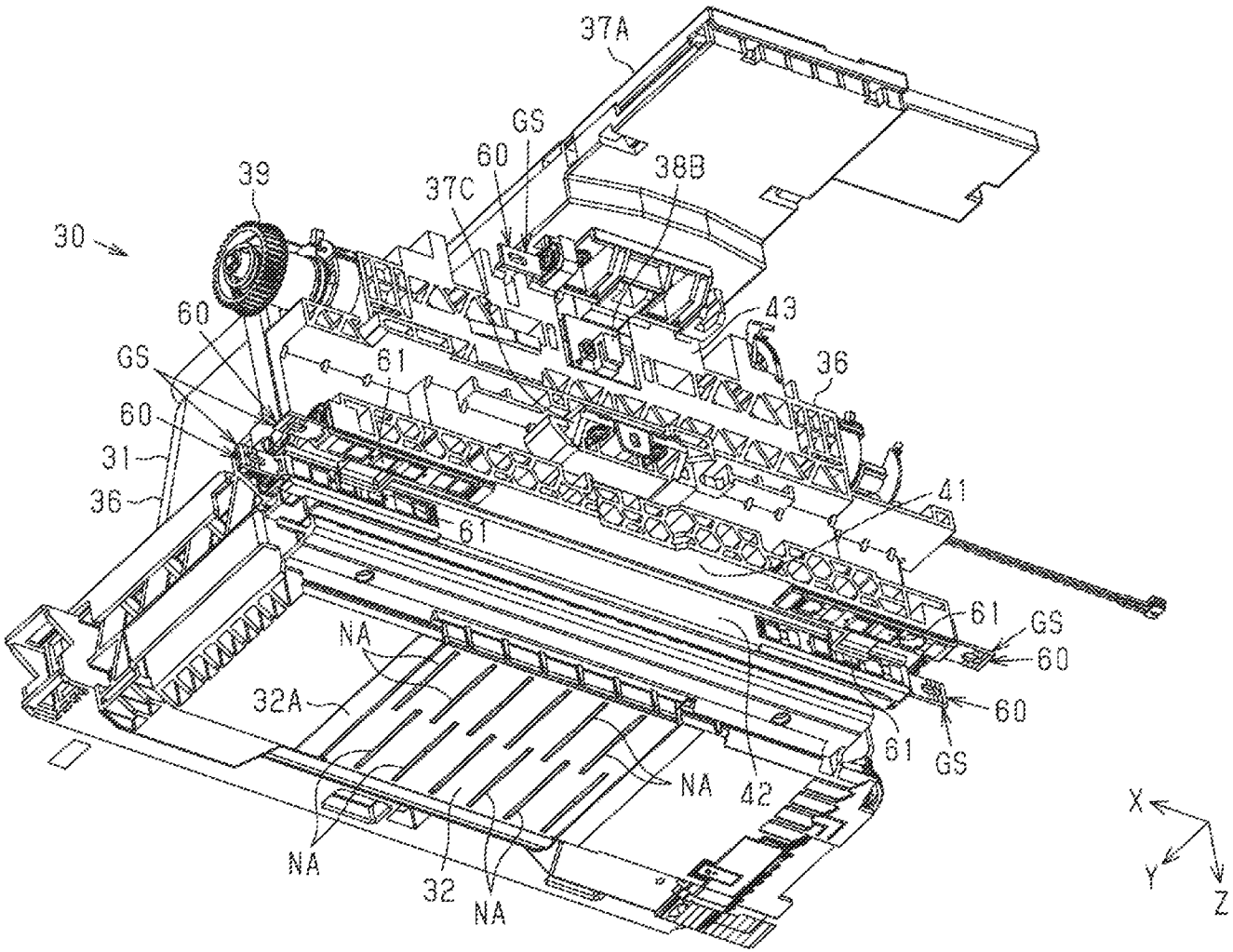
FIG. 5 is a perspective view of the recording part as viewed from a bottom side.

As illustrated in FIG. 5, the recording head 32 is provided at a center in the bottom portion of the carriage 31. In the recording head 32, the bottom surface that faces the support base 28 (see FIG. 2) is the nozzle surface 32A where a plurality of nozzles (not illustrated) is open. In the nozzle surface 32A, a plurality of nozzles (not illustrated) that performs recording on the recording medium 23 by discharging liquid is disposed. At the nozzle surface 32A, a large number of nozzles are open at an even interval in one direction. The plurality of nozzles makes up nozzle rows NA. The openings of the nozzles are arranged in the conveyance direction Y of the recording medium 23, and make up the plurality of nozzle rows NA. The nozzles that make up one nozzle row NA discharge the liquid of the same type. In the nozzles that make up one nozzle row NA, the nozzle located on the upstream side in the conveyance direction Y and the nozzle located on the downstream side in the conveyance direction Y are formed at positions shifted in the width direction X. The plurality of nozzle rows NA is arranged in the width direction X in a unit of two rows close to each other.

Figure 6:
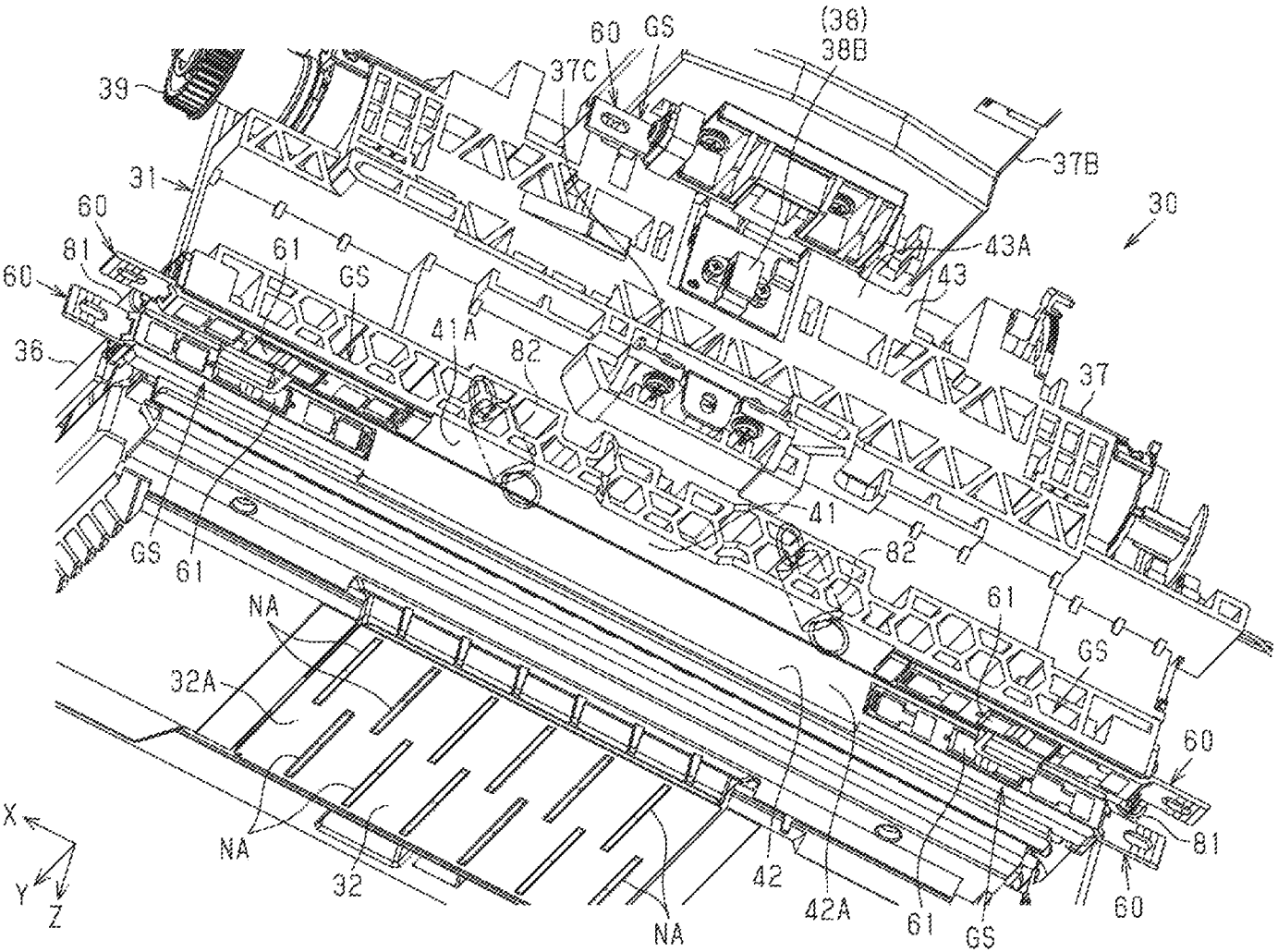
FIG. 6 is a perspective view illustrating a plurality of sliding portions in a carriage.

As illustrated in FIG. 6, the carriage supporting part 37 includes the three mounting parts 41 to 43. The three mounting parts 41 to 43 include mounting surfaces 41A to 43A to which the sliding unit 60 is mounted. The three mounting surfaces 41A to 43A are different from each other in the direction perpendicular to the surfaces. Specifically, the first mounting surface 41A is a surface oriented such that the direction perpendicular to the first mounting surface 41A is the +Z direction. The second mounting surface 42A is a surface oriented such that the direction perpendicular to the second mounting surface 42A is the −Y direction. The third mounting surface 43A is a surface oriented such that the direction perpendicular to the third mounting surface 43A is the +Y direction. The first mounting surface 41A and the second mounting surface 42A are formed in a lower portion of the carriage supporting part 37, and the third mounting surface 43A is formed in an upper portion of the carriage supporting part 37.

Figure 7:
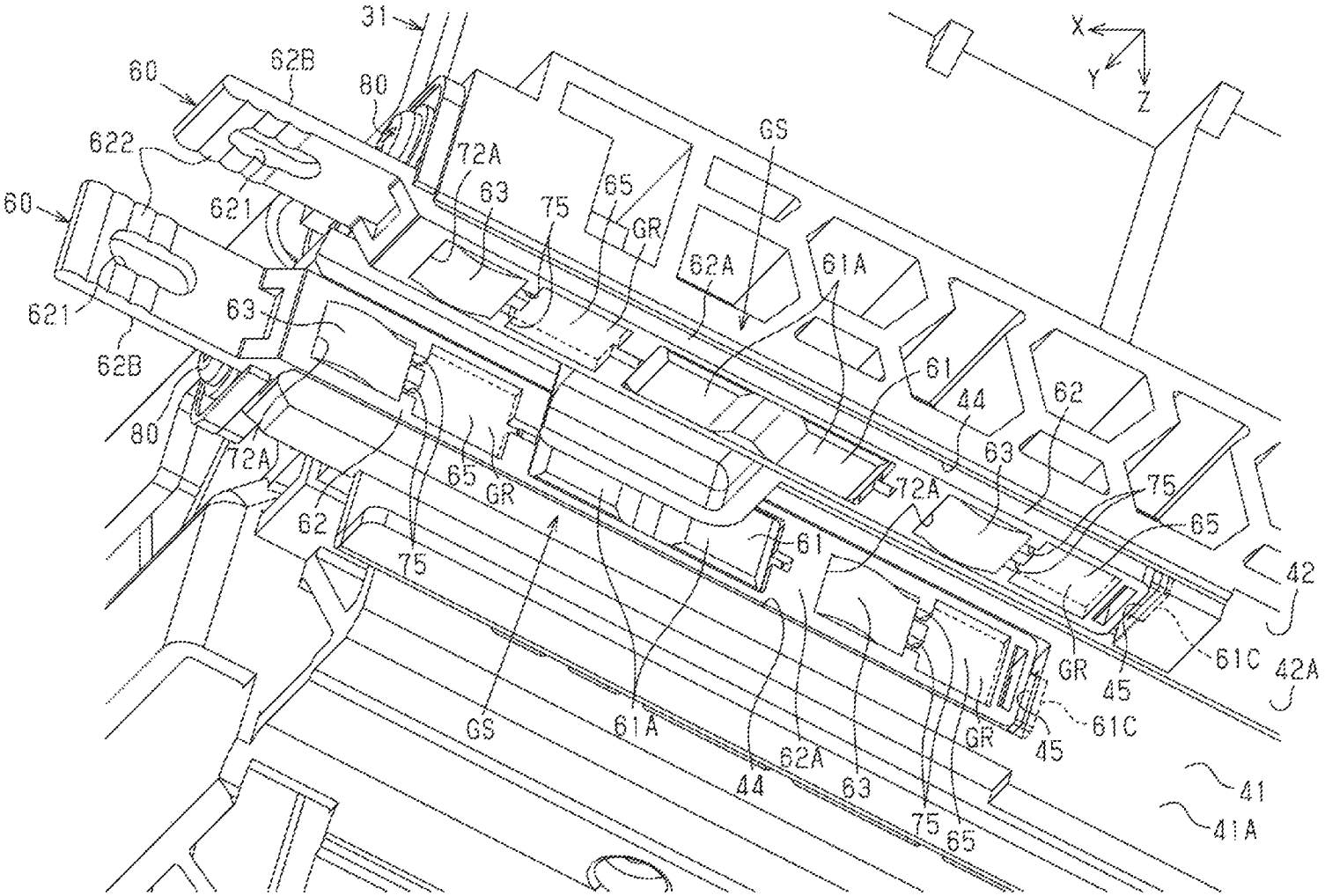
FIG. 7 is a perspective view illustrating sliding portions of two types in the carriage.

As illustrated in FIG. 6, the sliding unit 60 is detachably provided for each of the mounting surfaces 41A to 43A of three types with different orientations. The sliding unit 60 of this embodiment is detachably attached to the carriage 31. More specifically, as illustrated in FIG. 7, the sliding unit 60 is mounted in the state where it is slidable along a slide part 44 formed in the carriage 31. In this example, the sliding unit 60 can be attached and detached by sliding it in the scanning direction X to the slide part 44. The sliding unit 60 is fixed to the carriage 31 with the screw 80 in the state where the sliding unit 60 is mounted to the slide part 44, and the sliding unit 60 is thus retained so as to prevent the removal due to the movement in the scanning direction X.

Figure 8:
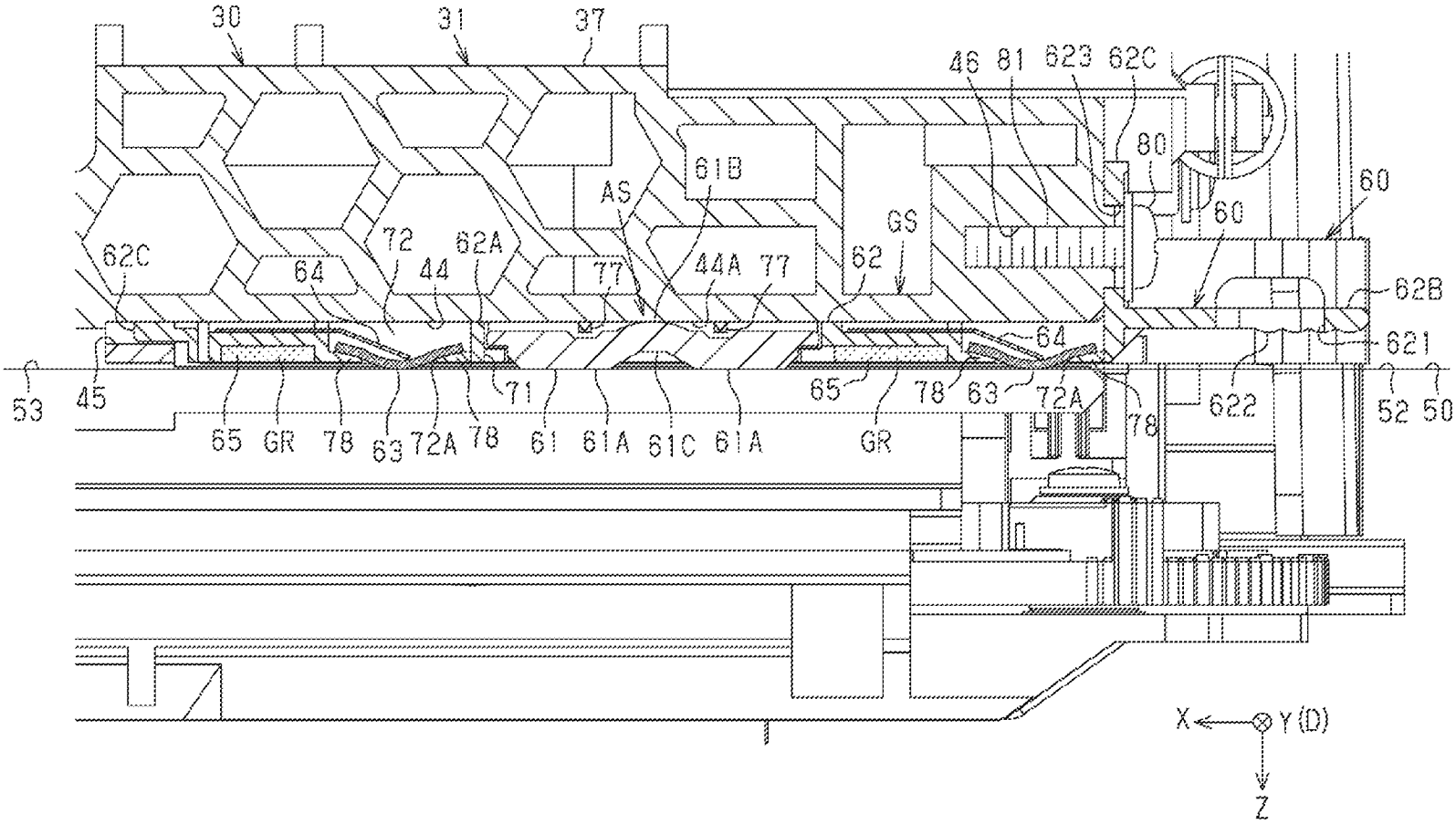
FIG. 8 is a back sectional view illustrating a cross section of a sliding unit mounted to the carriage.

As illustrated in FIG. 7 and FIG. 8, the sliding unit 60 includes the slider 62 in which the sliding part 61, an impregnated member 63 and a pressure member 64 are mounted. The slider 62 is detachably provided to the carriage 31. When the sliding part 61 is worn out, it suffices to replace the entire slider 62 for the sliding unit 60, which makes it easier to perform replenishment of the lubricant GR and replacement of the impregnated member 63.

As illustrated in FIG. 7 and FIG. 8, the slider 62 is inserted to the slide part 44 in the scanning direction X, and fixed with the screw 80 from the scanning direction X. The slider 62 includes a holding part 62B. The holding part 62B includes a hole 621 (see FIG. 9). The hole 621 is used to dismount the slider 62 by hooking a jig or the like, for example. In addition, the holding part 62B includes an anti-slip part 622 (see FIG. 9).

The plurality of sliding units 60 is mounted to the carriage 31. The carriage 31 is provided with a plurality of the sliders 62, and the sliders 62 have the same shape. The sliding parts 61 that are different from each other in the directions in which they are pressed against the rail surfaces 53 to 55 may use the common slider 62. In this case, the manufacturing cost of the carriage 31 is suppressed by using the common parts of the slider 62. In addition, the same sliding parts 61 may use the common sliding unit 60. In this case, by using the common parts of the sliding unit 60, the manufacturing cost of the carriage 31 is further suppressed.

As illustrated in FIG. 7 and FIG. 8, the carriage 31 includes the sliding part 61, and the impregnated member 63 impregnated with the lubricant GR. The lubricant GR includes grease. Further, the carriage 31 includes a storage part 65 that stores the lubricant GR that is supplied to the impregnated member 63. In this embodiment, the sliding part 61, the impregnated member 63 and the storage part 65 are configured as the sliding unit 60 such that they are collectively disposed in one member. The sliding part 61 can be replaced for each sliding unit 60.

As illustrated in FIG. 7 and FIG. 8, the carriage 31 includes, at least on one side of the sliding part 61 in the scanning direction X, the impregnated member 63 impregnated with the lubricant GR, and the pressure member 64 that presses the impregnated member 63 to the guide member 50 side from the surface on the side opposite to the guide member 50 with respect to the impregnated member 63. In this embodiment, the carriage 31 includes the impregnated member 63 impregnated with the lubricant GR on both sides of the sliding part 61 in the scanning direction X. The impregnated members 63 on both sides are pressed by the pressure member 64 to the guide member 50 side from the surface on the side opposite to the guide member 50. The impregnated member 63 impregnated with the lubricant GR is, for example, a felt member impregnated with the lubricant GR. The lubricant GR is, for example, grease. The grease is oil that is semifluid at normal temperature. The lubricant GR may be oil that is liquid at normal temperature, or may include a mixture of grease and oil. Note that regarding the position and number of the impregnated member 63, it may be disposed on one side, not both sides, of the sliding part 61 in the scanning direction X. In this example, the impregnated member 63 may be composed of a felt member impregnated with the lubricant GR.

The pressure force of the pressure member 64 is smaller than the pressure force of carriage 31 against the guide member 50. Here, the pressure force of carriage 31 against the guide member 50 is referred to as a first pressure force F, and the pressure force of the pressure member 64 is referred to as a second pressure force f. The first pressure force F of the carriage 31 pressing the rail surfaces 53 to 55 is a pressure force based on the own weight of the recording part 30, the biasing force of the springs 81 and 82 and the like, and the moment of the own weights and biasing forces. The pressure member 64 is, for example, a spring. In the case where the pressure member 64 is a spring, it may be the leaf spring illustrated in FIG. 7 and FIG. 8, or a coil spring that can bias the impregnated member 63, for example.

The pressure force of the pressure member 64 may be smaller than half the pressure force of carriage 31 against the guide member 50. For example, the second pressure force f of the pressure member 64 may be smaller than 1/20 to 1/2 of the first pressure force F of the carriage 31 against the guide member 50. The second pressure force f of the pressure member 64 is far smaller than the first pressure force F, and may be smaller than 1/20 to 1/5 of the first pressure force F, for example. The second pressure force f of the pressure member 64 may be approximately 1/10 of the first pressure force F, for example.

By setting the second pressure force f of the pressure member 64 to a value smaller than the first pressure force F, the destabilization of the orientation due to the carriage 31 floated from the guide member 50 and the like is easily prevented. In addition, a situation where the impregnated member 63 is excessively strongly pressed and the lubricant GR is excessively ejected is easily prevented.

In this embodiment, the sliding units 60 are disposed at a plurality of locations in the carriage 31. In the case where the pressure members 64 are the common parts among the plurality of sliding units 60, the biasing force of the pressure member 64 is smaller than the minimum load of the carriage 31 against the rail surfaces 53 to 55. On the other hand, in the case where the biasing force of the pressure member 64 is changed to different pressure forces among the plurality of sliding units 60, the pressure force f of each pressure member 64 is set to a value smaller than the load against each carriage 31. Even when the loads of the carriage 31 received at the sliding mechanism GS are different from each other, it suffices that the pressure force of each pressure members 64 is smaller than the minimum load of the carriage 31.

Here, when the pressure member 64 presses the impregnated member 63 against the rail surfaces 53 to 55 with an excessive force, the carriage 31 pressed by the rail surfaces 53 to 55 with the excessive force turns such that its orientation is deviated from the proper orientation, and the other sliding part 61 loses the contact with the rail surfaces 53 to 55 due to the floating from the rail surfaces 53 to 55 and the like. In addition, when the pressure member 64 strongly presses the impregnated member 63 against the rail surfaces 53 to 55 with an excessive force, the lubricant GR impregnated in the impregnated member 63 is excessively exuded. This results in premature lubricant exhaustion and the increase in the load of the slide movement of the sliding part 61 on the rail surfaces 53 to 55, and the durability of the carriage 31 is impaired. On the other hand, in the case where the sliding part 61 does not make contact with the rail surfaces 53 to 55, the lubricant GR cannot be supplied to the sliding part 61. Also in this case, the load of the slide movement of the sliding part 61 on the rail surfaces 53 to 55 is increased and the durability of the carriage 31 is impaired.

Especially in the case where the impregnated member 63 is composed of a material that easily absorbs the liquid lubricant GR such as cloth and fiber, it is easily affected by humidity, and it is therefore difficult to manage the contact pressure between the sliding part 61 and the rail surfaces 53 to 55. Note that the pressure member 64 is not limited as long as the pressure member 64 can press the impregnated member 63 to the guide member 50 side from the surface on the side opposite to the guide member 50 with respect to the impregnated member 63, and the pressure member 64 may be a spring such as a leaf spring, or an elastic synthetic resin sheet or film.

The pressure member 64 presses substantially the entire impregnated member 63 in the direction that intersects the scanning direction X. In this example in which the impregnated member 63 is composed of a flexible felt member, the impregnated member 63 may be pressed from the back surface by a portion (end portion), linearly extending in the direction that intersects the scanning direction X, of the pressure member 64 composed of a leaf spring. In this manner, substantially the entire width of the impregnated member 63 in the direction that intersects the scanning direction X is brought into contact with the guide member 50.

As described above, the sliding unit 60 may include a structure that pushes out the impregnated member 63 composed of a felt member at a predetermined force. The impregnated member 63 that supplies the lubricant GR is disposed near the front and rear of the sliding part 61 of the carriage 31 in the scanning direction X, and the impregnated member 63 is configured to be pressed against the rail surfaces 53 to 55 of the guide member 50. Specifically, the pressure member 64 with a weak elastic force is brought into contact with a center portion of the impregnated member 63 composed of a felt member on the side opposite to the side that faces the rail surfaces 53 to 55, and the impregnated member 63 is pressed with the weak elastic force of the pressure member 64.

For example, in the case where the guide member 50 is a columnar guide shaft, when the sliding part provided to surround the periphery of the guide shaft inserted to an insertion portion on the carriage side strongly makes contact in one direction, the contact on the opposite side becomes weak, and therefore the positions of the carriage and the guide shaft are adjusted to make an appropriate contact. On the other hand, in the configuration of this embodiment in which the guide member 50 is a guide rail, when the sliding part 61 is displaced from the rail surfaces 53 to 55 in the orthogonal direction, an excessively strong contact or a poor contact results. Thus, it is important to manage the contact pressure between the sliding part 61 and the rail surfaces 53 to 55.

In this embodiment, the impregnated member 63 is biased by the pressure member 64 in the same direction as the load of the carriage 31 against the rail surfaces 53 to 55 such as the own weight of the carriage 31, the biasing force of the spring, and the moment of the biasing force of the spring. In this manner, the excessively strong contact or the poor contact on the sliding surface (rail surface) among the plurality of sliding parts 61 is avoided. The biasing force of the pressure member 64 biasing the impregnated member 63 may be set to a strength smaller than the load of the carriage 31 against the rail surfaces 53 to 55.

In this embodiment, the felt member that makes up the impregnated member 63 is pushed out from the back side by the pressure member 64. Since the biasing force (spring force) of the pressure member 64 can be managed, the impregnated member 63 composed of a felt member can be reliably brought into contact with the rail surfaces 53 to 55, and a turning deviation in which the impregnated member 63 (for example, a felt member) is pressed against at least one of the rail surfaces 53 to 55 with an excessive force and the carriage 31 is turned from the normal orientation is not caused. Thus, the sliding part 61 of the carriage 31 does not float from the rail surfaces 53 to 55.

The sliding unit 60 includes a dropping prevention structure for the impregnated member 63. In the surface of the slider 62 opposite to the surface that faces the guide member 50, a holding part 78 that holds the impregnated member 63, and an opening 72A formed at a position facing the guide member 50 in the holding part 78. Two opposite sides at the outer periphery part of the impregnated member 63 in the scanning direction X are supported by the outer edge of the opening 72A. The center portion of the impregnated member 63 in the scanning direction X is pressed by the pressure member 64 to make contact with the guide member 50.

As illustrated in FIG. 8, the impregnated member 63 is held at the slider 62 by covering the peripheral portion of the impregnated member 63 with the holding part 78 from the rail surface 53 (54, 55) side. The center portion of the impregnated member 63 is pressed by the pressure member 64 from the back surface, and thus the impregnated member 63 is protruded and exposed from the opening 72A to the rail surface 53 (54, 55) side. In this embodiment, the peripheral portion of the impregnated member 63 is covered with the holding part 78 formed in the slider 62 from the rail surface 53 (54, 55) side. In this manner, the dropping of the impregnated member 63 from the slider 62 is prevented.

Since sliding of the sliding part 61 on the rail surfaces 53 to 55 alone results in a large sliding resistance, the impregnated member 63 that supplies the lubricant GR is disposed. The impregnated member 63 is, for example, a felt member impregnated with grease as the lubricant GR, and when the impregnated member 63 is pressed against the rail surfaces 53 to 55 by the pressure member 64 with a predetermined pressure force, the lubricant GR is exuded and the exuded lubricant GR is supplied to the rail surfaces 53 to 55.

As illustrated in FIG. 8, the carriage 31 may include the storage part 65. In this embodiment, the sliding unit 60 includes the storage part 65. The reason for this is that the lubricant GR impregnated in the felt member alone results in shortage of the lubricant GR for the lifetime of the recording apparatus 11. The storage part 65 is located next to the impregnated member 63 in the scanning direction X. The storage part 65 includes a housing recess 73 provided in a recessed manner such that the lubricant GR can be stored in the slider 62 (see FIG. 9), the lubricant GR housed in the housing recess 73, and a groove part 75 that communicates between the housing recess 73 and a housing space in which the impregnated member 63 is housed (see FIG. 9). When the lubricant GR in the felt member is consumed, the lubricant GR in the liquid form is supplied to the impregnated member 63 from the storage part 65 through the groove part 75, by capillary action or the like. In this manner, the lubricant GR of the storage part 65 is supplied to the impregnated member 63, and the lubricant GR is further supplied from the impregnated member 63 to the rail surfaces 53 to 55.

As illustrated in FIG. 8, the sliding mechanism GS includes an aligning mechanism AS in which even when the rail surfaces 53 to 55 (sliding surface) have a curvature such as undulation, a contact part 61A thereof can follow the rail surfaces 53 to 55. The sliding unit 60 and the sliding part 61 are separate members, and are provided to be swayable around the axis line that is parallel to the direction that intersects at least the scanning direction X with respect to the slider.

The sliding part 61 includes the contact part 61A that makes contact with the guide member 50 over a predetermined length in the direction along the scanning direction X, and a protrusion part 61B that makes contact with the carriage 31 at the rear surface at the intermediate position of the contact part 61A in the scanning direction X.

Since the back surface part of sliding part 61 has a convex surface shape, the protrusion part 61B formed on the back surface of the sliding part 61 makes point contact or line contact with a frame surface 44A of the carriage 31. The protrusion part 61B of the sliding part 61 may be formed in a convex spherical shape (see FIG. 10), for example. With a convex spherical shape, it can be swayed around the axis line parallel to the scanning direction X with respect to the slider 62.

Figure 13:
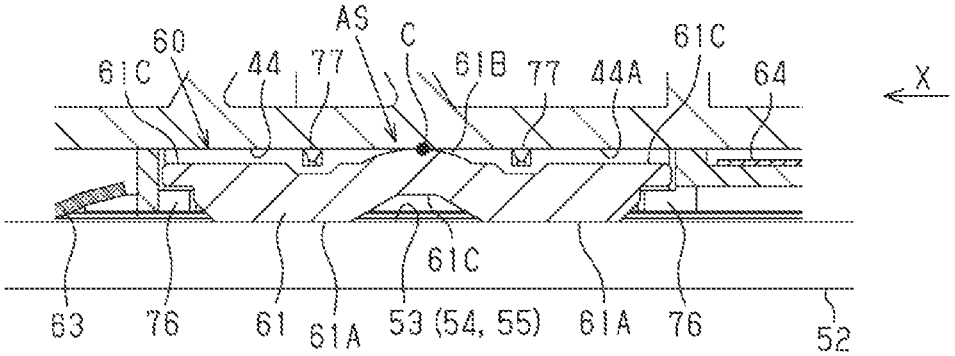
FIG. 13 is a sectional view illustrating an operation of a sliding part.
Figure 14:
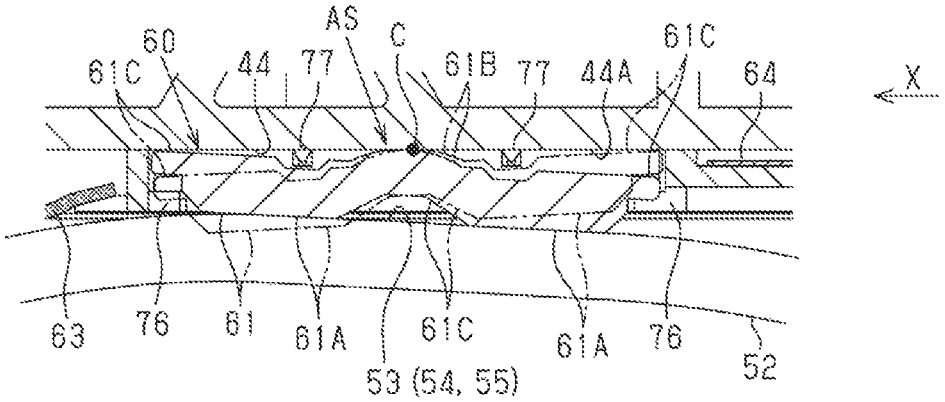
FIG. 14 is a sectional view illustrating an operation of sway of the sliding part.

Thus, the sliding part 61 is swayable with the point contact portion or the contact portion of the protrusion part 61B as a fulcrum C (see FIG. 13 and FIG. 14). Thus, the sliding part 61 can follow the rail surfaces 53 to 55 in the state where a wide contact area between the contact part 61A and the rail surface 53 (54, 55) is maintained even when the rail surfaces 53 to 55 (sliding surfaces) are curved. Thus, the orientation of the carriage is stabilized by reliably bringing the contact part of the sliding part 61 into contact with the rail surfaces 53 to 55.

Figure 9:
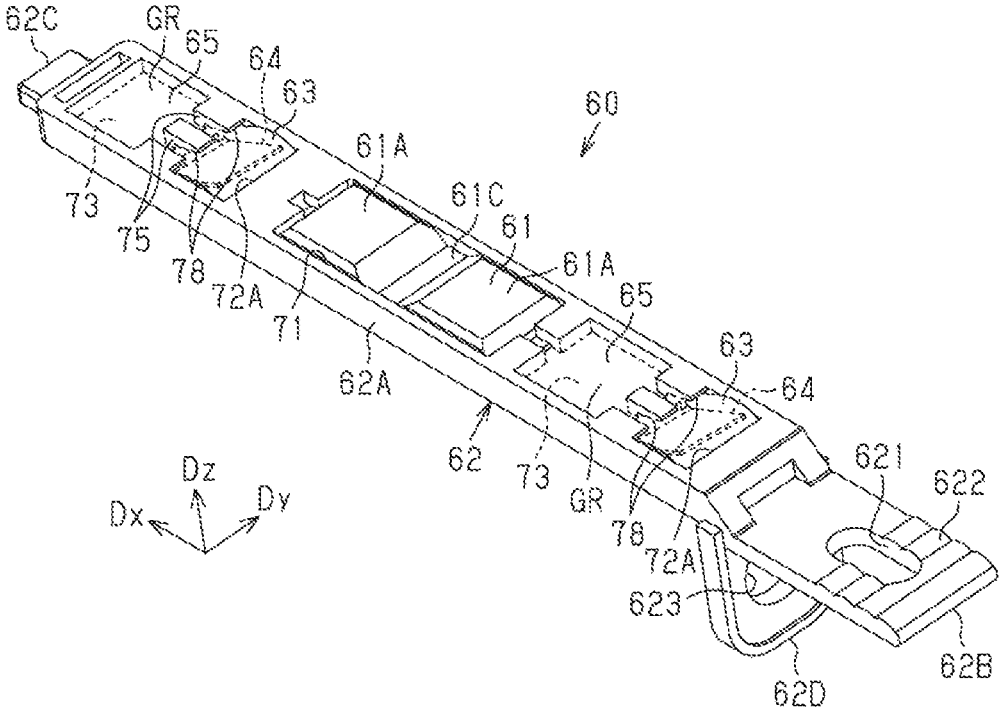
FIG. 9 is a perspective view of the sliding unit as viewed from a sliding surface side.

As illustrated in FIG. 8 and FIG. 9, the sliding part 61 includes a recess 61C that does not make contact with the guide member 50 at a center portion in the scanning direction X. That is, the contact part 61A is separated into two parts with the recess 61C therebetween in the scanning direction X. The sliding resistance of the carriage 31 can be reduced by reducing the contact area while stabilizing the orientation by increasing the length of the contact part 61A in the scanning direction X.

Next, a specific configuration of the sliding unit 60 is described with reference to FIG. 9 and FIG. 10. Note that in FIG. 9 to FIG. 12, Dx is the longitudinal direction, Dy is the short direction, and Dz is the thickness direction of the sliding unit 60. For example, in the sliding unit 60 mounted along the rail surface 53, the longitudinal direction Dx coincides with the scanning direction X, the short direction Dy coincides with the conveyance direction Y, and the thickness direction Dz coincides with the vertical direction Z.

As illustrated in FIG. 9, in a first surface, which is on the sliding surface side, of the sliding unit 60, the sliding part 61 is mounted at a center portion in the longitudinal direction Dx. The contact part 61A of the sliding part 61 is separated into two parts on both sides with the recess 61C formed at a center portion in the longitudinal direction Dx therebetween.

As illustrated in FIG. 9, the center portion of the back surface of the impregnated member 63 is pressed by the end portion of the pressure member 64 in the state where the peripheral portions on both sides in the scanning direction X are held at the holding part 78. The sliding unit 60 includes the storage part 65 that stores the lubricant GR at a position arranged side by side with the holding part 78 in the scanning direction X. The groove part 75 that guides the lubricant GR from the storage part 65 to the impregnated member 63 held in the holding part 78 is provided between the storage part 65 and the holding part 78.

The sliding unit 60 includes the holding part 62B protruding in the scanning direction X at one end portion in the longitudinal direction Dx. In the holding part 62B, the hole 621 and the anti-slip part 622 are formed.

In addition, in the sliding unit 60, a lock part 62C protrudes at an end portion on the side opposite to the holding part 62B in the scanning direction X. When the sliding unit 60 is slid by the slide part 44 and inserted to the terminal end position, the lock part 62C is inserted to a hole 45 (see FIG. 7 and FIG. 8) on the carriage 31 side, and thus the end side is positioned. In addition, the sliding unit 60 includes a supporting part 62D that protrudes to the second surface, which is the surface on the side opposite to the first surface in the thickness direction Dz that intersects the protruding direction of the holding part 62B. In the supporting part 62D, a screw insertion hole 623 through which the shaft part of the screw 80 can be inserted is formed.

Figure 10:
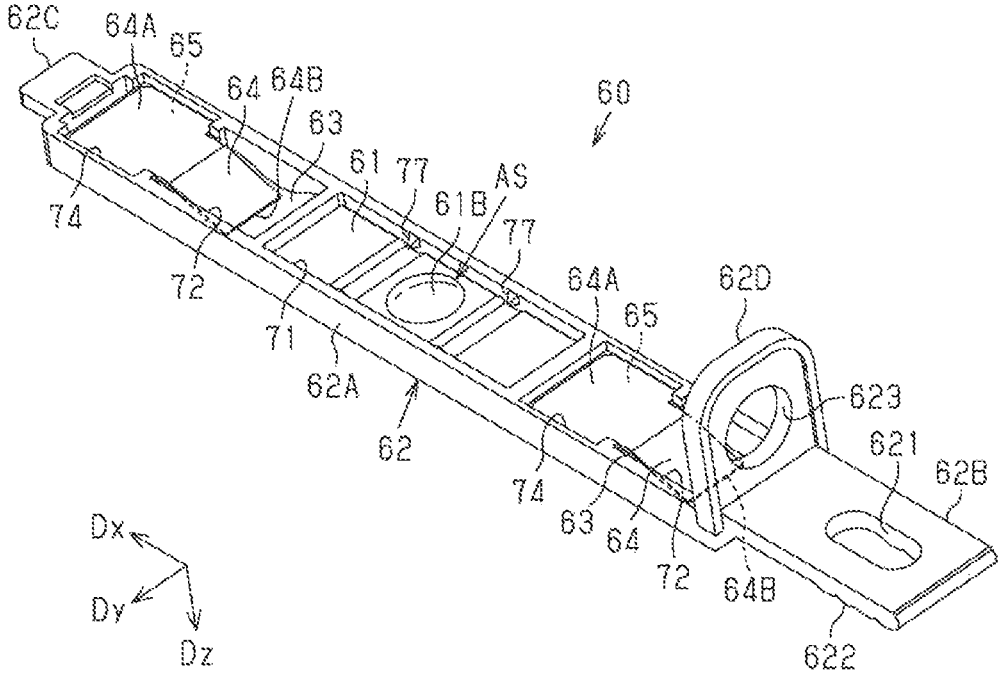
FIG. 10 is a perspective view of the sliding unit as viewed from a surface on the side opposite to the sliding surface.

As illustrated in FIG. 10, the protrusion part 61B with a convex spherical surface is formed on the back side of a center portion of the sliding part 61 in the scanning direction X. At the convex spherical surface, the protrusion part 61B makes contact with the frame surface 44A (see FIG. 8), which is the bottom surface of the slide part 44, in the state where the sliding unit 60 is fit to the slide part 44. The frame surface 44A is a flat surface. The protrusion part 61B makes point contact with the frame surface 44A at the convex spherical surface, and thus the sway of the sliding part 61 with the point contact position as the fulcrum is achieved. In the slider 62, a recess 74 is provided in a recessed manner at a position next to a housing hole 72 in the longitudinal direction Dx. The recess 74 functions as an attaching portion for attaching a base part 64A of the pressure member 64. In the state where the base part 64A is attached to the recess 74, an end portion 64B of the pressure member 64 presses the impregnated member 63 from the back side. Note that the recess 74 of this example is provided at a position opposite to the housing recess 73 in the surface on the side opposite to the surface in which the housing recess 73 is provided in a recessed manner in the slider 62.

Next, a specific configuration of the slider 62 is described with reference to FIG. 11 and FIG. 12.

Figure 11:
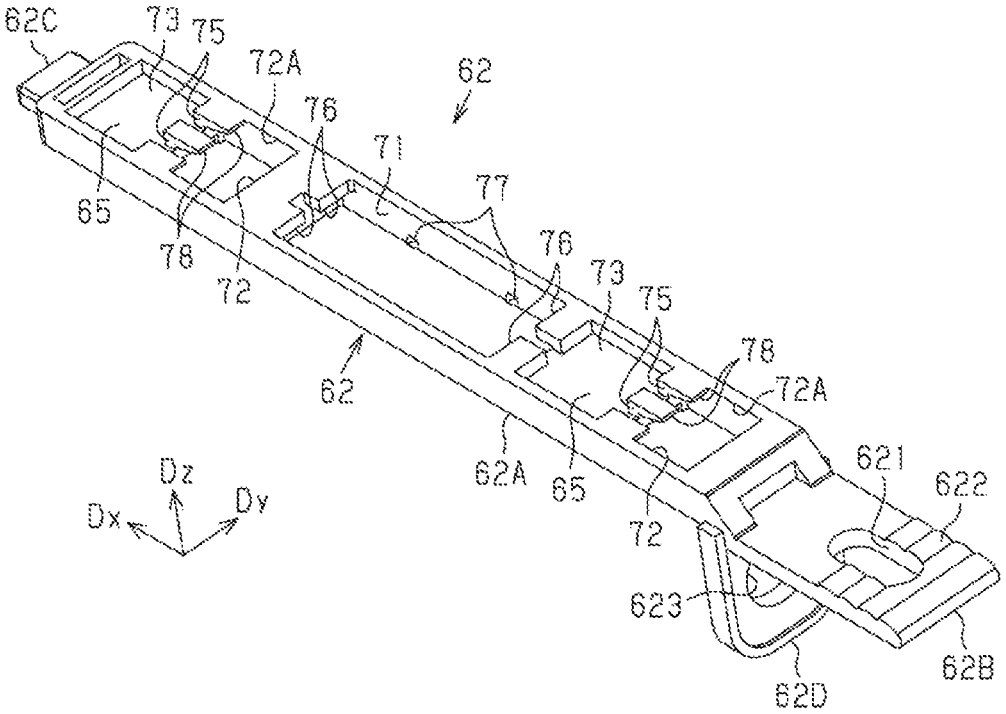
FIG. 11 is a perspective view of a slider of the sliding unit as viewed from a sliding surface side.
Figure 12:
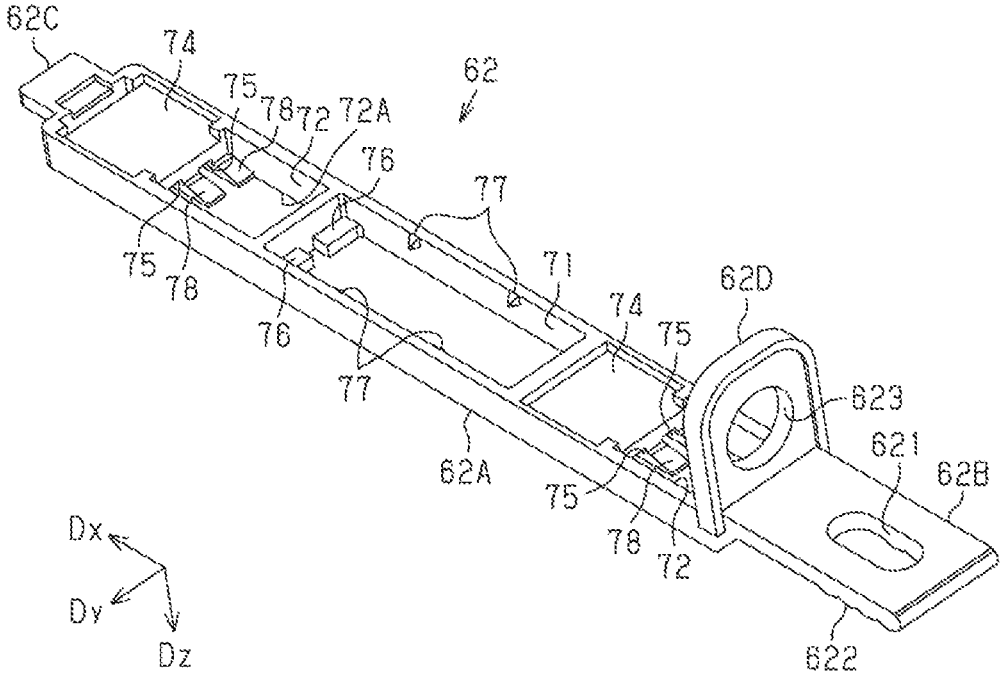
FIG. 12 is a perspective view of the slider of the sliding unit as viewed from the surface on the side opposite to the sliding surface side.

As illustrated in FIG. 11, the slider 62 includes, in its slider main body 62A, a housing hole 71 that houses the sliding part 61, the housing hole 72 including the opening 72A that exposes the impregnated member 63, and the housing recess 73 that serves as the storage part 65 that stores the lubricant GR. The slider 62 includes a plurality of restriction parts 76 and a plurality of protrusions 77 at the inner wall surface of the housing hole 71 that houses the sliding part 61. In the state where the sliding part 61 (see FIG. 9) is mounted to the housing hole 71 of the slider 62, the plurality of restriction parts 76 restricts the displaceable range, to the rail surface 53 (54, 55) (see FIG. 14) side in the thickness direction Dz, of the both end portions of the sliding part 61 in the longitudinal direction Dx. In addition, the plurality of protrusions 77 functions as a retainer of the sliding part 61 mounted to the housing hole 71 of the slider 62. Then, with the plurality of restriction parts 76 and the plurality of protrusions 77, the sway allowance of the sliding part 61 with the point contact portion of the protrusion part 61B as the fulcrum C (see FIG. 14) is defined. In addition, as illustrated in FIG. 11, the groove part 75 that communicates between the housing hole 72 and the housing recess 73 is formed between the housing hole 72 and the housing recess 73. The slider 62 includes the above-described holding part 62B and lock part 62C at the both end portions in the longitudinal direction Dx. In addition, the slider 62 includes above-described supporting part 62D that protrudes from the base part of the holding part 62B in the direction that intersects the protrusion direction of the holding part 62B. The screw insertion hole 623 is formed in supporting part 62D.

Next, an operation of the recording apparatus 11 is described.

Since the impregnated member 63 is provided on the both sides of the sliding part 61 in the scanning direction X, the lubricant GR is supplied to the rail surfaces 53 to 55. For example, in FIG. 8, in the outward movement in which the carriage 31 moves in the +X direction, the lubricant GR is supplied to the rail surface 53 from the impregnated member 63 located on the downstream side (in FIG. 8, the left side) in the travelling direction. Then, when the sliding part 61 slides on the rail surface 53 (54, 55) on which the lubricant GR has been supplied, the lubricant GR is supplied between the rail surface 53 (54, 55) and the sliding part 61.

In addition, in FIG. 8, in the homeward movement in which the carriage 31 moves to the −X direction, the lubricant GR is supplied to the rail surface 53 (54, 55) from the impregnated member 63 located on the downstream side in the travelling direction (in FIG. 8, the right side). Then, when the sliding part 61 slides on the rail surface 53 (54, 55) on which the lubricant GR has been supplied, the lubricant GR is supplied between the rail surface 53 (54, 55) and the sliding part 61. In this manner, in this embodiment, the impregnated member 63 is disposed on both sides of the sliding part 61 in the scanning direction X, and thus the lubricant GR can be reliably supplied to the rail surface 53 both in the outward movement and in the homeward movement of the carriage 31. This also applies to the case where the sliding part 61 of the sliding mechanism GS slides on other rail surfaces 54 and 55.

In addition, the impregnated member 63 is pressed by the pressure member 64 to the guide member 50 side from the side opposite to the side that faces the guide member 50. Therefore, even when the orientation of the carriage 31 is deviated from the proper orientation, the impregnated member 63 is pressed by the pressure member 64, and thus the impregnated member 63 is less floated from the rail surface 53 composed of the flat surface of the guide member 50. Thus, the impregnated member 63 can reliably slide on the rail surface 53 (54, 55), and the lubricant GR is reliably supplied to the rail surface 53 (54, 55).

In addition, the load of the recording part 30, due to the moment generated by the turning movement of the carriage 31 by the own weight of the recording part 30, the biasing force of the springs 81 and 82 for pressing the sliding part 61 against the rail surfaces 53 to 55, and the own weights and biasing forces, is exerted on the rail surfaces 53 to 55 through the sliding part 61. In the case where the pressure force of the pressure member 64 is set to a value smaller than the load of recording part 30, or more specifically a value smaller than half the load of the recording part 30, it is possible to avoid a situation where the load of the recording part 30 against the rail surfaces 53 to 55 is excessively increased due to the pressure force of the pressure member 64, the orientation is deviated by a turning movement of the carriage 31, and the other sliding part 61 floats from the rail surfaces 53 to 55. That is, each sliding part 61 makes contact with the rail surfaces 53 to 55 with an appropriate contacting pressure. As a result, the orientation of the carriage 31 is stabilized when the carriage 31 moves back and forth in the scanning direction X during the recording. In addition, since the lubricant GR is reliably supplied, it is possible to avoid a situation where the sliding resistance between the sliding part 61 and the rail surfaces 53 to 55 is increased due to shortage of the lubricant GR, and the load of the movement of the carriage 31 along the guide member 50 in the scanning direction X is increased, for example. Thus, for example, the carriage 31 can move in a stable orientation and at a stable speed. As a result, the recording on the recording medium 23 can be performed with a high recording accuracy.

Further, the sliding unit 60 includes the aligning mechanism AS that allows the sliding part 61 to follow the curved rail surfaces 53 to 55 even when the rail surfaces 53 to 55 have a curvature such as undulation. For example, as illustrated in FIG. 13, when the carriage 31 moves along a flat rail surface 53 (54, 55), the sliding part 61 slides with the contact part 61A held in a stationary orientation parallel to the rail surface, and both two contact parts 61A making contact with the rail surface 53 (54, 55).

In addition, as illustrated in FIG. 14, in the case where the rail surface 53 (54, 55) has a curvature such as undulation, the sliding part 61 sways to follow around the rail surface 53 (54, 55) as the fulcrum C. Specifically, as indicated with the solid line in FIG. 14, the sliding part 61 turns clockwise around the fulcrum C, and thus follows the rail surface 53 (54, 55). In addition, as indicated with the chain double-dashed line in FIG. 14, the sliding part 61 turns counter-clockwise around the fulcrum C, and thus follows the rail surface 53 (54, 55). Even when the rail surface 53 (54, 55) has a curvature such as undulation, the orientation of the moving carriage 31 is stabilized.

In addition, the sliding part 61 ensures the sway allowance that allows the sliding part 61 to sway around the fulcrum C until it is engaged with the plurality of protrusions 77 protruded at a position at a small distance relative to its back surface when it is in a stationary orientation illustrated in FIG. 13. In addition, when the sliding unit 60 is dismounted from the carriage 31, the sliding part 61 has a retainer function that prevents the removal from the slider 62 through the engagement with the plurality of protrusions 77. As a result, it can support the sliding part 61 in a swayable manner, and serve as a retainer for dismounting the sliding unit 60.

Figure 15:
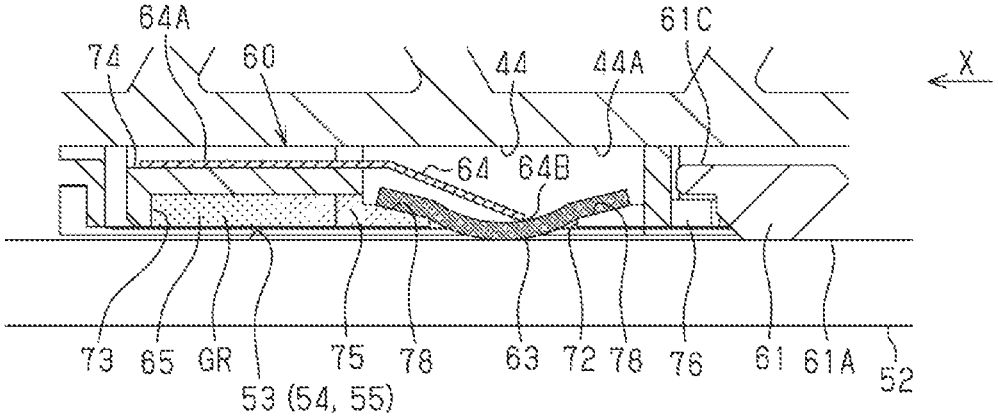
FIG. 15 is a partial sectional view of the sliding unit, illustrating a state where lubricant is supplied from a storage part to an impregnated member.

In addition, as illustrated in FIG. 15, the impregnated member 63 is replenished with the lubricant GR stored in the storage part 65 through the groove part 75. Thus, the shortage of the lubricant GR impregnated in the impregnated member 63 less occurs. In addition, the number of times of replacement of the sliding unit 60 in the lifetime of the recording apparatus 11 can be reduced.

In addition, the impregnated member 63 is pressed to the rail surface 53 (54, 55) side by the pressure member 64. The base part 64A of the pressure member 64 is attached to the recess 74, and the end portion 64B of the pressure member 64 presses an approximate center portion of the impregnated member 63 in the scanning direction X. When the impregnated member 63 and the rail surface 53 (54, 55) move away from each other, the protruding amount of the impregnated member 63 from the opening 72A is increased by the pressure force of the pressure member 64, and thus it can follow while maintaining the state where it is pressed against the rail surface 53 (54, 55). Thus, even if the other sliding part 61 floats at other rail surfaces 54 and 55 due to the turning movement of the carriage 31 due to the curvature of the rail surface 53 (54, 55) and/or an excessive load of the recording part 30 against the rail surface 53, the state where the impregnated member 63 makes contact with the rail surface 53 (54, 55) can be maintained.

In addition, the peripheral portion of the opposite two sides of the impregnated member 63 in the scanning direction X is held by the holding part 78 that is tilted in the direction that approaches the rail surface 53 (54, 55) side as it comes closer to the opening 72A. Thus, the impregnated member 63 whose center portion of the back surface is pressed by the pressure member 64 can be bulged with a curve from the opening 72A. For example, in the case where the holding part 78 has a rectangular cross-sectional shape, the impregnated member 63 may be bent at the corner of the rectangular cross section of the holding part 78, and the fibers of the felt member may become dense in a region around the bent portion, making the impregnation of the lubricant GR difficult, for example.

In addition, even the opening 72A with the same opening size, it is possible to ensure a relatively large projection area, which is projected on the opposite rail surfaces 53 to 55, of the portion of the impregnated member 63 bulged from the opening 72A. That is, even with the same opening size of the opening 72A, it is possible to ensure a relatively large contact area of the impregnated member 63 with the rail surfaces 53 to 55.

The maintenance such as the replenishment of the lubricant GR to the storage part 65 and the replacement of the sliding part 61 is performed by dismounting the sliding unit 60 from the carriage 31. Since the sliding part 61, the impregnated member 63 and the pressure member 64 are mounted in the sliding unit 60, the sliding part 61, the impregnated member 63 and the pressure member 64 can be collectively dismounted at once by dismounting the sliding unit 60 from the carriage 31.

Figure 16:
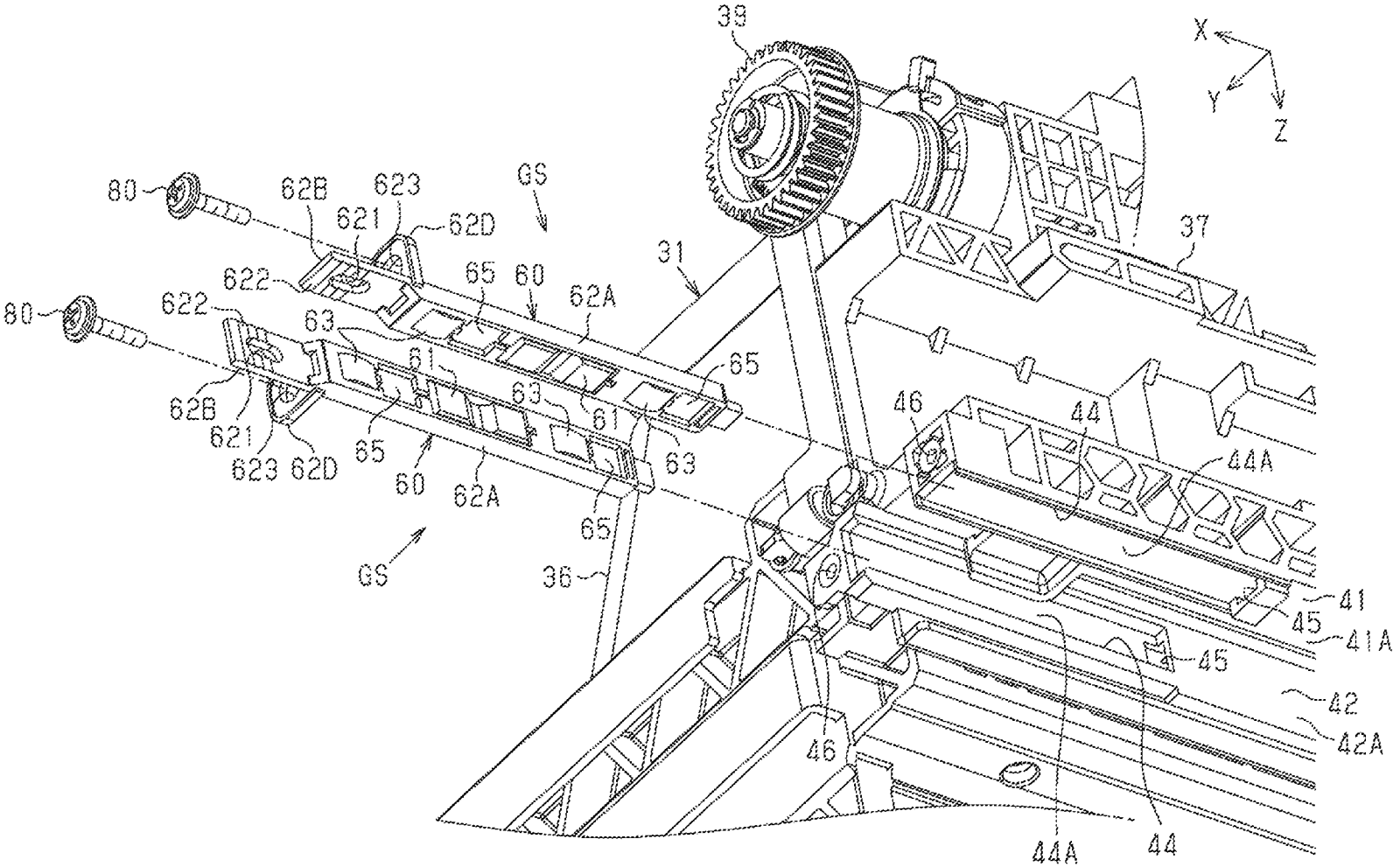
FIG. 16 is a perspective view for describing a procedure of attaching/detaching the sliding unit to the carriage.

As illustrated in FIG. 16, first, the screw 80 is loosened and removed, and then the sliding unit 60 is slid in a dismounting direction in the scanning direction X by holding the holding part 62B to dismount it from the carriage 31. In addition, it can be pulled out by hooking a tool, a wire or the like to the hole 621 formed in the holding part 62B. For example, even in a narrow space where the worker's hand cannot reach, the sliding unit 60 can be dismounted from the carriage 31 by using a tool or a wire. Then, in the maintenance, the maintenance of the impregnated member and/or the sliding part 61 of the sliding unit 60 is performed, and the storage part 65 is replenished with the lubricant GR. In addition, when replacing the sliding unit 60, a new sliding unit 60 is prepared.

Then, the sliding unit 60 after the replacement is mounted to the carriage 31 by sliding it along the slide part 44 in the scanning direction X. After the carriage 31 is mounted, the screw 80 is fastened to a screw hole 46 on the carriage 31 side by using a tool such as a driver (see FIG. 7).

According to the embodiment, the following effects are achieved.

(1) The recording apparatus 11 includes the recording head 32 that performs recording on the recording medium 23 being conveyed in the conveyance direction D, the carriage 31 that performs scanning in the scanning direction X that intersects the conveyance direction D with the recording head 32 mounted therein, and the guide member 50 including the rail surfaces 53 to 55 as an example of a flat surface that guides the carriage 31 in the scanning direction X. The carriage 31 includes the sliding part 61 that slides in contact with the guide member 50, the impregnated member 63 impregnated with the lubricant GR at least on one side of the sliding part 61 in the scanning direction X, and the pressure member 64 that presses the impregnated member 63 to the guide member 50 side from the surface on the side opposite to the guide member 50 with respect to the impregnated member 63. With this configuration, the impregnated member 63 is pressed by the pressure member 64 to the guide member 50 side, and thus separation of the impregnated member 63 from the guide member 50 is suppressed. Thus, in comparison with a configuration including no pressure member 64, the lubricant GR can be more reliably supplied from the impregnated member 63 to the rail surfaces 53 to 55 of the guide member 50 on which the sliding part 61 slides. It is possible to suppress the increase in the sliding resistance of the carriage 31 due to the stagnation of the supply of the lubricant GR to the guide member 50.

(2) The pressure force of the pressure member 64 is smaller than the pressure force of carriage 31 against the guide member 50. Thus, it is possible to suppress the deviation of the carriage 31 from the proper orientation due to the pressure force of the pressure member 64.

(3) The pressure force of the pressure member 64 is smaller than half the pressure force of carriage 31 against the guide member 50. Thus, it is possible to prevent the orientation from being destabilized due to the floating of the carriage 31 and the like. In addition, it is possible to prevent a situation where the sliding part 61 and the impregnated member 63 strongly make contact with the guide member 50 and the lubricant GR is excessively ejected from the impregnated member 63.

(4) The recording apparatus 11 includes the slider 62 in which the sliding part 61, the impregnated member 63 and the pressure member 64 are mounted. The slider 62 is detachably provided to the carriage 31. In this manner, when the sliding part 61 is worn out, it suffices to replace only the slider 62. In addition, it is easy to perform the replenishment of the lubricant GR and the replacement of the impregnated member 63.

(5) The carriage 31 is provided with the plurality of sliders 62 with the same shape. Thus, by using the common parts of the plurality of sliders 62, the manufacturing cost of the recording apparatus 11 can be reduced.

(6) The slider 62 and the sliding part 61 are separate members. The sliding part 61 is provided to be swayable around the axis line parallel to the direction that intersects at least the scanning direction X with respect to the slider 62. With this configuration, even when the sliding surface of the guide member 50 is curved, the sliding part 61 can change the orientation of the sliding part 61 by following the curved sliding surface, and thus the contact part 61A of the sliding part 61 can be reliably brought into contact with the guide member 50 when the carriage 31 moves in the scanning direction X. Thus, the carriage 31 can be held in a stable orientation.

(7) The sliding part 61 includes the contact part 61A that makes contact with the guide member 50 over a predetermined length in the direction along the scanning direction X, and the protrusion part 61B including a convex surface that makes contact with the carriage 31 at the rear surface at the intermediate position of the contact part 61A in the scanning direction X. With this configuration, the sliding part 61 can be supported in a swayable manner with a simple configuration. Thus, it is possible to achieve the guide structure that guides the carriage 31 with the guide member 50 such that the carriage 31 is movable in the scanning direction X, with a simple configuration.

(8) The contact part 61A of the sliding part 61 includes the recess 61C that does not make contact with the guide member 50 in a center portion in the scanning direction X. With this configuration, the contact part 61A of the sliding part 61 is separated into a plurality of regions with a recess therebetween in the scanning direction X. Thus, the sliding resistance of the carriage 31 can be reduced by reducing the contact area, while stabilizing the orientation by increasing the length of the contact part 61A of the sliding part 61 in the scanning direction X.

(9) The impregnated member 63 is disposed on both sides in the scanning direction X with respect to the sliding part 61. With this configuration, in both the back-and-forth movement and the homeward movement of the carriage 31, the lubricant GR can be supplied between the sliding part 61 and the guide member 50 from the impregnated member 63.

(10) The slider 62 includes the holding part 78 provided at the surface opposite to the surface that faces the guide member 50 and configured to hold the impregnated member 63, and the opening 72A formed at a position that faces the guide member 50 in the holding part 78. The two opposite sides of the outer periphery part of the impregnated member 63 in the scanning direction X are supported by the outer edge of the opening 72A, and a center portion of the impregnated member 63 in the scanning direction X is pressed by the pressure member 64 to make contact with the guide member 50. Thus, the dropping of the impregnated member 63 from the slider 62 can be prevented.

(11) The pressure member 64 presses the impregnated member 63 at a portion linearly extending in the direction that intersects the scanning direction X. In this manner, the entire width or substantially the entire width of the impregnated member 63 in the direction that intersects the scanning direction X can be brought into contact with the guide member 50.

(12) The storage part 65 that stores the lubricant GR at a position arranged side by side with the holding part 78 in the scanning direction X is provided, and the groove part 75 that guides the lubricant GR from the storage part 65 to the impregnated member 63 held by the holding part 78 is provided between the storage part 65 and the holding part 78. Thus, the lubricant GR can be supplied the storage part 65 that stores the lubricant GR to the impregnated member 63. In comparison with the configuration including no storage part 65, the carriage 31 can be stably moved for a long period of time without a large load, even without performing the replenishment of the lubricant GR.

Note that the above-described embodiments may be modified as the following modifications. Further, the above-described embodiments and the following modifications may be further appropriately modified, and the following modifications may be appropriately combined as another modification.

The pressure force (second pressure force) of the pressure member 64 may be greater than half the second pressure force as long as it is smaller than the pressure force (first pressure force) of the carriage 31 against the guide member 50.

The storage part 65 may be disposed on the upper side of the impregnated member 63. In addition, the storage part 65 may be on the upper side of the sliding part 61.

The storage part 65 need not be provided.

The convex surface as the surface shape of the protrusion part 61B of the sliding part 61 need not be a spherical surface, and may be a half columnar shape. In this case, the arc surface (convex surface) of the half columnar shape is brought into contact with the frame surface 44A on the carriage 31 side.

The sliding part 61 may be fixed to the slider 62 in a non-swayable manner.

The slide direction may be the conveyance direction Y instead of the scanning direction X.

The sliding unit 60 may be configured to be detachable in the direction orthogonal to the surface on the carriage 31 side instead of the slidable configuration.

While the sliding unit 60 is mounted to the carriage 31 with the plurality of sliding parts 61 facing three directions in the above description, the facing directions of the plurality of sliding parts 61 may be two directions. For example, the plurality of sliding parts 61 facing two directions, the +Z direction and the −Y direction, may be provided in the carriage 31. In addition, the plurality of sliding parts 61 facing the two directions, the +Z direction and the +Y direction, may be provided in the carriage 31. In addition, it is possible to adopt a configuration in which only a sliding part facing one direction slides on the guide member 50.

All of the plurality of sliders 62 need not be a common component. Only some of the plurality of sliders 62 may be a common component.

The guide member 50 may be a member separated from the main frame.

A spring that biases the sliding part 61 in the vertical direction Z with respect to the rail surface 53 may be provided.

A configuration in which only two of the sliding part 61, the impregnated member 63 and the storage part are integrally mounted to the carriage 31 may be adopted. For example, a configuration in which the impregnated member 63 and the storage part 65 are integrally configured and they are members separated from the sliding part 61 may be adopted.

A configuration in which the sliding part 61, the impregnated member 63 and the storage part are separately mounted to the carriage 31 may be adopted.

The technical ideas and effects derived from the above-described embodiments and modifications are described below.

(A) A recording apparatus includes a recording head configured to perform recording on a recording medium being conveyed in a conveyance direction, a carriage in which the recording head is mounted, the carriage being configured to perform scanning in a scanning direction that intersects the conveyance direction, and a guide member including a flat surface configured to guide the carriage in the scanning direction. The carriage includes a sliding part configured to slide in contact with the guide member, an impregnated member impregnated with lubricant on at least one side of the sliding part in the scanning direction, and a pressure member configured to press the impregnated member to the guide member side from a surface on a side opposite to the guide member with respect to the impregnated member.

With this configuration, since the impregnated member is pressed by the pressure member to the guide member side, the separation of the impregnated member from the guide member is suppressed. Thus, the lubricant can be more reliably supplied from the impregnated member to the surface of the guide member where the sliding part slides. The increase in the sliding resistance of the carriage due to the stagnation the supply of the lubricant to the guide member can be suppressed.

(B) In the recording apparatus, a pressure force of the pressure member may be smaller than a pressure force of the carriage against the guide member.

With this configuration, since the pressure force of the pressure member is smaller than the pressure force of the carriage against the guide member, the deviation of the carriage from the proper orientation due to the pressure force of the pressure member can be suppressed.

(C) In the recording apparatus, the pressure force of the pressure member may be smaller than half the pressure force of the carriage against the guide member.

With this configuration, the destabilization of the orientation due to the float of the carriage and the like can be prevented. In addition, a situation where the sliding part and the impregnated member strongly make contact with the guide member and the lubricant of the impregnated member is excessively ejected can be prevented.

(D) The recording apparatus may further include a slider in which the sliding part, the impregnated member and the pressure member are mounted. The slider may be detachably provided to the carriage.

With this configuration, when the sliding part is worn out, it suffices to replace only the slider. It is easy to perform the replenishment of the lubricant and the replacement of the impregnated member.

(E) In the recording apparatus, the carriage may be provided with a plurality of sliders, and the plurality of sliders may have a same shape.

With this configuration, by using the common parts of the plurality of sliders, the manufacturing cost of the recording apparatus can be reduced.

(F) In the recording apparatus, the slider and the sliding part may be separate members, and the sliding part may be provided to be swayable around an axis line parallel to a direction that intersects at least the scanning direction with respect to the slider.

With this configuration, even when the sliding surface of the guide member is curved, the sliding part can follow the curved sliding surface and change the orientation of the sliding part, and thus the contact part of the sliding part can be reliably brought into contact with the guide member when the carriage moves in the scanning direction. Thus, the carriage can be held in a stable orientation.

(G) In the recording apparatus, the sliding part may include a contact part configured to make contact with the guide member over a predetermined length in a direction along the scanning direction, and a protrusion part including a convex surface configured to make contact with the carriage at a rear surface at an intermediate position of the contact part in the scanning direction.

With this configuration, the sliding part can be supported in a swayable manner with a simple configuration. Thus, the guide structure that guides the carriage such that the carriage is movable in the scanning direction using the guide member can be achieved with a simple configuration.

(H) In the recording apparatus, the contact part of the sliding part may include a recess that does not make contact with the guide member at a center portion in the scanning direction.

With this configuration, the contact part of the sliding part is separated into a plurality of regions with a recess therebetween in the scanning direction. In this manner, the sliding resistance of the carriage can be reduced by reducing the contact area while stabilizing the orientation by increasing the length of the contact part of the sliding part in the scanning direction.

(I) In the recording apparatus, the impregnated member may be disposed on both sides of the sliding part in the scanning direction.

With this configuration, the lubricant can be supplied between the sliding member and the guide member from the impregnated member in both the outward movement and the homeward movement of carriage.

(J) The recording apparatus may further include a holding part provided at a surface opposite to a surface that faces the guide member in the slider, and configured to hold the impregnated member, and an opening formed at a position that faces the guide member in the holding part. Two sides opposite each other in the scanning direction at an outer periphery part of the impregnated member may be supported by an outer edge of the opening, and a center portion of the impregnated member in the scanning direction may be pressed by the pressure member to make contact with the guide member.

With this configuration, the dropping of the slider from the impregnated member can be prevented.

(K) In the recording apparatus, the pressure member may press the impregnated member at a portion linearly extending in a direction that intersects the scanning direction.

With this configuration, since the pressure member presses the impregnated member at a portion extending in the direction that intersects the scanning direction, the entire width or substantially the entire width of the impregnated member in the direction that intersects the scanning direction can be brought into contact with the guide member.

(L) The recording apparatus may further include a storage part configured to store the lubricant at a position arranged side by side with the holding part in the scanning direction. A groove part configured to guide the lubricant from the storage part to the impregnated member held by the holding part may be provided between the storage part and the holding part.

With this configuration, the lubricant can be supplied to the impregnated member from the storage part that stores the lubricant. In comparison with the configuration including no storage part, the carriage can be stably moved for a long period of time without a large load, even without performing the replenishment of the lubricant.

What is claimed is:

1. A recording apparatus comprising:

a recording head configured to perform recording on a recording medium being conveyed in a conveyance direction;

a carriage in which the recording head is mounted, the carriage being configured to perform scanning in a scanning direction that intersects the conveyance direction; and a guide member including a flat surface configured to guide the carriage in the scanning direction, wherein the carriage includes:

a sliding part configured to slide in contact with the guide member;

an impregnated member impregnated with lubricant on at least one side of the sliding part in the scanning direction; and a pressure member configured to press the impregnated member to the guide member side from a surface on a side opposite to the guide member with respect to the impregnated member.

2. The recording apparatus according to claim 1, wherein a pressure force of the pressure member is smaller than a pressure force of the carriage against the guide member.

3. The recording apparatus according to claim 2, wherein the pressure force of the pressure member is smaller than half the pressure force of the carriage against the guide member.

4. The recording apparatus according to claim 1, comprising a slider in which the sliding part, the impregnated member and the pressure member are mounted, wherein the slider is detachably provided to the carriage.

5. The recording apparatus according to claim 4, wherein the carriage is provided with a plurality of sliders; and the plurality of sliders have the same shape.

6. The recording apparatus according to claim 5, comprising:

a holding part provided at a surface of the slider opposite to a surface that faces the guide member, and configured to hold the impregnated member; and an opening formed at a position in the holding part that faces the guide member, wherein two sides opposite each other in the scanning direction at an outer periphery part of the impregnated member are supported by an outer edge of the opening; and a center portion of the impregnated member in the scanning direction is pressed by the pressure member to make contact with the guide member.

7. The recording apparatus according to claim 6, comprising a storage part configured to store the lubricant at a position arranged side by side with the holding part in the scanning direction, wherein a groove part configured to guide the lubricant from the storage part to the impregnated member held by the holding part is provided between the storage part and the holding part.

8. The recording apparatus according to claim 4, wherein the slider and the sliding part are separate members; and the sliding part is provided to be swayable, with respect to the slider, around an axis line parallel to a direction that intersects at least the scanning direction.

9. The recording apparatus according to claim 8, wherein the sliding part includes:

a contact part configured to make contact with the guide member over a predetermined length in a direction along the scanning direction; and a protrusion part including a convex surface at a rear surface at an intermediate position of the contact part in the scanning direction, the convex surface being configured to make contact with the carriage.

10. The recording apparatus according to claim 9, wherein the contact part of the sliding part includes, at a center portion thereof in the scanning direction, a recess that does not make contact with the guide member.

11. The recording apparatus according to claim 1, wherein the impregnated member is disposed on both sides of the sliding part in the scanning direction.

12. The recording apparatus according to claim 1, wherein the pressure member presses, at a portion thereof, the impregnated member, the portion linearly extending in a direction that intersects the scanning direction.

* * * * *